US011581173B2

(12) United States Patent
Giles et al.

(10) Patent No.: US 11,581,173 B2
(45) Date of Patent: Feb. 14, 2023

(54) APPARATUS FOR ANALYSING IONS

(71) Applicant: SHIMADZU CORPORATION, Kyoto (JP)

(72) Inventors: Alina Giles, West Yorkshire (GB); Roger Giles, West Yorkshire (GB)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/289,799

(22) PCT Filed: Nov. 19, 2019

(86) PCT No.: PCT/EP2019/081834

§ 371 (c)(1),
(2) Date: Apr. 29, 2021

(87) PCT Pub. No.: WO2020/109091

PCT Pub. Date: Jun. 4, 2020

(65) Prior Publication Data

US 2021/0398788 A1 Dec. 23, 2021

(30) Foreign Application Priority Data

Nov. 28, 2018 (GB) ..... 1819372

(51) Int. Cl.
*H01J 49/00* (2006.01)
*H01J 49/06* (2006.01)

(52) U.S. Cl.
CPC ..... *H01J 49/0045* (2013.01); *H01J 49/06* (2013.01)

(58) Field of Classification Search
CPC .. H01J 49/0027; H01J 49/0045; H01J 49/004; H01J 49/06; H01J 49/0031
See application file for complete search history.

(56) References Cited

U.S. PATENT DOCUMENTS 6,770,871 B1 8/2004 Wang et al.
7,507,953 B2 3/2009 Makarov et al.
(Continued)

FOREIGN PATENT DOCUMENTS

CA 2867909 A1 * 9/2013 ..... G01N 27/624
GB 2391697 A 2/2004
(Continued)

OTHER PUBLICATIONS

Wang et al., "A Qit-q-Tof mass spectrometer for two-dimensional tandem mass spectrometry", Rapid Communications in Mass Spectrometry, 2007, vol. 21, pp. 3223-3226 (5 pages).
(Continued)

*Primary Examiner* — David E Smith
(74) *Attorney, Agent, or Firm* — Sughrue Mion, PLLC

(57) ABSTRACT

An apparatus for analysing ions, including a first mass analyser configured to eject groups of ions in a predetermined sequence during different time windows; an ion transport device having a plurality of electrodes arranged around a transport channel; control means configured to control voltages applied to the electrodes to generate a transport potential in a transport channel, the transport potential having a plurality of potential wells configured to move along the transport channel such that each group of ions received by the ion transport device is respectively transported along the transport channel by one or more selected potential; fragmentation means configured to fragment precursor ions in each group of ions so as to produce product ions; and a second mass analyser configured to produce a respective mass spectrum using each group of ions after the group of ions has been fragmented and transported.

18 Claims, 6 Drawing Sheets

(56) References Cited

U.S. PATENT DOCUMENTS

| | | | | |
|---|---|---|---|---|
| 9,536,721 | B2 * | 1/2017 | Berdnikov | H01J 49/062 |
| 9,812,308 | B2 | 11/2017 | Berdnikov et al. | |
| 2004/0026612 | A1 | 2/2004 | Bateman et al. | |
| 2005/0023453 | A1 * | 2/2005 | Bateman | H01J 49/4225 250/288 |
| 2009/0278043 | A1 * | 11/2009 | Satake | H01J 49/4235 250/290 |
| 2010/0065737 | A1 * | 3/2010 | Bateman | H01J 49/062 250/283 |

FOREIGN PATENT DOCUMENTS

| | | | | |
|---|---|---|---|---|
| GB | 2421844 | A | 7/2006 | |
| JP | 2008-523554 | A | 7/2008 | |
| WO | 2006/061625 | A2 | 6/2006 | |
| WO | 2012/150351 | A1 | 11/2012 | |
| WO | WO-2012150351 | A1 * | 11/2012 | H01J 49/0095 |
| WO | 2018/114442 | A1 | 6/2018 | |
| WO | WO-2018189542 | A1 * | 10/2018 | H01J 49/0027 |

OTHER PUBLICATIONS

Hager, "A new linear ion trap mass spectrometer", Rapid Communications in Mass Spectrometry, 2001, vol. 16, pp. 512-526 (16 pages).

Ding et al., "A digital ion trap mass spectrometer coupled with atmospheric pressure ion sources", Journal of Mass Spectrometry, 2004, vol. 39, pp. 471-484 (14 pages total).

International Search Report dated Feb. 4, 2020 in Application No. PCT/EP2019/081834.

Written Opinion of the International Searching Authority dated Feb. 4, 2020 in Application No. PCT/EP2019/081834.

* cited by examiner

APPARATUS FOR ANALYSING IONS

CROSS REFERENCE TO RELATED APPLICATIONS

This application is a National Stage of International Application No. PCT/EP2019/081834, filed Nov. 19, 2019, claiming priority to British Patent Application No. 1819372.2, filed Nov. 28, 2018.

FIELD OF THE INVENTION

The present invention relates to an apparatus for analysing ions.

BACKGROUND

Many sources of charged particles, such as electrospray ion sources, produce a continuous stream of charged particles (continuous in time), rather than discrete bunches of charged particles. However, for many analysis devices configured to analyse charged particles, it is preferable for charged particles to be analysed in bunches, rather than as a continuous stream. An example of such an analysis device is a time of flight ("ToF") analyser.

Transport devices configured to transport charged particles along a transport channel in one or more bunches have therefore been developed.

An example of such a transport device is described in WO2012/150351 (also published as U.S. Pat. Nos. 9,536,721, 9,812,308). This transport device, which hereafter may be referred to as the "A-device", uses a non-uniform high-frequency electric field, the pseudopotential of which has a plurality of potential wells, each suitable for transporting a respective bunch of charged particles.

A transport device that generates a potential having similar qualities to the A-device, albeit by analogue rather than digital means, is also disclosed in US2009/278043.

Another example of such a transport device is described in GB2391697. This transport device, which may hereafter be referred to as a "T-Wave" device, ion guide or collision cell, produces a DC electric field that includes a plurality of potential wells, each suitable for transporting a respective bunch of charged particles. In the "T-Wave" device, RF waveforms are applied in antiphase to alternate ring-electrodes in a stacked ring system so as to generate a radial confinement field. A travelling DC potential is applied sequentially to electrodes to generate a DC barrier which urges the radially trapped ions along the device. Multiple DC barriers may be formed in order to separate the trapped ions into bunches.

Thus, in both the A-device and T-Wave device, a plurality of electrodes are controlled to generate a transport potential in a transport channel, the transport potential having a plurality of potential wells configured to transport charged particles along the transport channel in one or more groups/bunches.

WO2018/114442 described a transport device implementing the principles of the A-device described in WO2012/150351, wherein a "bunch forming potential" was generated in a "bunch forming region" so as to provide a selected potential well with a bunch of charged particles in a manner that helps to reduce spillage and/or scattering of the charged particles compared e.g. with a method in which a bunch of charged particles is injected directly into a channel in which a transport potential is continuously generated.

In mass spectrometry, MS/MS techniques are well known. These techniques typically involve selection of precursor ions, fragmentation of those precursor ions to produce product ions, and then generation of a spectrum based on the product ions.

In conventional MS/MS analyses, the selection of precursor ions tends to involve disposing the non-selected precursor ions, each time precursor ions are selected.

However, some MS/MS techniques which seek to avoid loss of precursor ions have been proposed.

U.S. Pat. No. 6,770,871 describes an MS/MS mass spectrometer which seeks to avoid loss of precursor ions. The MS/MS mass spectrometer of U.S. Pat. No. 6,770,871 has a first mass analyser, a preferably ion trap, a collision cell for daughter ions production (it means fragmentation by collision induced dissociation (CID) or IRMPD which provides equivalent fragmentation to CID) and a second mass analyser (preferably TOF) that performs the analysis much faster than the scanning rate of the first mass analyser. Col. 6 lines 39-52 state that the second (preferably ToF) ion detector is much faster than the first one to provide a good resolution of the MS/MS mass spectrum data. FIGS. 1 and 2 provide schematics of the device proposed by U.S. Pat. No. 6,770,871, and FIG. 4 shows an illustrative 2 dimensional MS/MS spectrum (or precursor x product spectrum) calculated for illustrative purposes.

The present inventors have noted the following limitations of the device proposed by U.S. Pat. No. 6,770,871:

- Ions have short residence in the collision cell and proceed directly to mass analysis by ToF. Thus we see that U.S. Pat. No. 6,770,871 is restricted to CID as the fragmentation method as it is fast enough. CID does not preserve post translational modification ("PTM") information and thus has limited value in proteomic studies.
- The second analyser must be fast with respect to the first analyser, this is because precursor ions ejected from the ion trap are not kept together, but become somewhat spread out in time and space, as they travel through the collision cell, and the derived product ions become further spread out in time as pass into the pusher region of the ToF analyser, furthermore this spreading out in time is mass dependent. So the ToF analyser must be fast to 'sample' the time dispersed ion bunch as it enters the 'pusher region' of the ToF, which may analyse a sufficient mass range of the CID derived product ions, albeit at a low duty cycle, typically less than <20%.
- A further consequence of the 'spreading out' of precursor and product ions is that ions from adjacent ejected precursor ions will be mixed together limiting the resolving power on the precursor ion axis. This leaves the user of this prior art system needing to make an inevitable compromise between the chromatographical resolution, mass resolving power in the product ion axis, mass range of the daughter ions, transmission or complexity of the precursor analyte. Col. 7 lines 13-27 demonstrate a principal limitation of the resolution of the MS/MS mass spectra that comes from the fact that there is a limit to ToF pusher frequency.
- A further decrease of resolution and transmission comes from the fact that there is not enough time for daughter ions to cool down sufficiently.
- A final and important limitations is that the 3D ion trap disclosed in U.S. Pat. No. 6,770,871 has a limited charge capacity, ~4000 charges before space charge forces between ions results in the loss of resolving power and changing of the ejection times. Thus to provide statistically significant MS/MS spectra, one would need to average and significant number of MS/MS spectra, making this prior art system incompatible with LC.

The present inventors are not aware of a marketed device which implements the disclosure of U.S. Pat. No. 6,770,871 (which was filed in 2002), though a prototype was made [7]. The present inventors believe this could be explained by the restricting limitations identified above.

U.S. Pat. No. 7,507,953 (see e.g. FIG. 1) describes methods to improve an MS/MS instrument performance by replacing the 3D trap of ions from linear ion trap or traps (LIT-MS) and disclosed various collision cell geometries for accepting ions ejected by an elongated 'ribbon' that is produced by a LIT. These methods teach how to overcome the space charge issues of U.S. Pat. No. 6,770,871. The basic arrangement for MS/MS systems is substantially equivalent to U.S. Pat. No. 6,770,871 and therefore shares all the limitations listed for U.S. Pat. No. 6,770,871. It is a trap for scanning of the precursors, a fragmentation cell and a fast scanning mass analyser (TOF). U.S. Pat. No. 7,507,953 discusses the principal limitations of MS/MS experiment that come from scan rates of LIT and TOF and the time ions spend travelling from LIT to the final mass analyser (TOF), see col. 16 lines 12-32.

The present invention has been devised in light of the above considerations.

SUMMARY OF THE INVENTION

A first aspect of the present invention provides:

An apparatus for analysing ions, the apparatus including:

a first mass analyser configured to eject groups of ions from the first mass analyser in a predetermined sequence such that each group of ions is ejected during a different time window and is initially formed from precursor ions having m/z values in a respective m/z value window, wherein the first mass analyser is configured to, when ejecting each group of ions, retain at least some of any other ions contained in the first mass analyser prior to the group of ions being ejected;

an ion transport device having a plurality of electrodes arranged around a transport channel, wherein the ion transport device is configured to receive at least some groups of ions ejected from the first mass analyser;

control means configured to control voltages applied to the electrodes of the ion transport device to generate a transport potential in the transport channel, the transport potential having a plurality of potential wells which are configured to move along the transport channel, the control unit being configured to generate the transport potential such that each group of ions received by the ion transport device is respectively transported along the transport channel by one or more selected potential wells in the transport potential;

fragmentation means configured to fragment precursor ions in each group of ions so as to produce product ions;

a second mass analyser configured to produce a respective mass spectrum using each group of ions after the group of ions has been fragmented by the fragmentation means and transported along the transport channel.

In this way, a mass spectrum can be produced for product ions resulting from fragmentation of multiple groups of precursor ions, each group of precursor ions having m/z values in different m/z value windows, e.g. for use in producing two dimensional mass spectrum data, or more complex forms of mass spectrum data (see below), with higher throughput, with fewer ions being lost, and with improved separation of groups of ions initially formed from precursor ions having different m/z values, compared to the prior art.

To realise these benefits, it is preferable for substantially all the ions in each group of ions (which may include precursor ions and/or product ions) to stay in the same one or more selected potential wells of the transport potential (preferably the same one selected potential well), whilst they are being transported by the transport potential, preferably so as to substantially avoiding mixing of different groups of ions. Some features that help to achieve this effect, e.g. by avoiding causing ions to spill into adjacent potential wells, are discussed in more detail below.

As indicated above, the first mass analyser is configured to, when ejecting each group of ions, retain at least some of any other ions contained in the first mass analyser prior to the group of ions being ejected. This means that if there are any other ions contained in the first mass analyser prior to a given group of ions being ejected, then at least some of those ions should be retained by the first mass analyser. Note here that reference is made to "any" other ions contained in the first mass analyser, since in some cases there might not be any other ions present in the first mass analyser when a given group of ions is being ejected (in which case there would be no ions left to be retained by the first mass analyser). This could be the case, for example, when all but one groups of ions have been ejected from the first mass analyser, and the ions contained in the first mass analyser all have m/z values within the m/z value window of a final group of ions to be ejected.

Preferably, the first mass analyser is configured to, when ejecting each group of ions, retain 50% or more of, preferably substantially all of, any other ions contained in the first mass analyser prior to the group of ions being ejected.

By configuring the first mass analyser to, when ejecting each group of ions, retain at least some of any other ions contained in the first mass analyser prior to the group of ions being ejected, the apparatus is able to avoid losing all other (non-selected) precursor ions from the first mass analyser each time a group of ions is ejected, as happens with most conventional MS/MS apparatuses. The apparatus may therefore be described as implementing a "retained precursor ion" technique Where the first mass analyser is configured to, when ejecting each group of ions, retain substantially all of any other ions that are contained in the first mass analyser prior to the group of ions being ejected, the apparatus may be described as implementing a "near-lossless" technique, since nearly all ions initially contained in the first mass analyser can be used for analysis by the apparatus. The first mass analyser may be configured to contain precursor ions from which the groups of ions are formed. The precursor ions may be derived from a sample, for example.

Techniques for retaining other ions when ejecting a group of ions from a mass analyser are discussed below.

Of course, the one or more selected potential wells transporting each group of ions should be different from the potential wells transporting other groups of ions, i.e. each group of ions should be transported by different potential wells, so as to avoid mixing of ions from each group.

For the avoidance of any doubt, each group of ions may be carried by more than one selected potential well, though one potential well per group of ions is preferred. Carrying each group in more than one selected potential well may degrade throughput, but could still provide a working system.

The potential wells are preferably pseudo-potential wells generated, for example, according to the techniques described in WO2012/150351.

The apparatus may include deriving means for deriving two dimensional mass spectrum data based on the mass spectra produced using each group of ions. Two dimensional mass spectrum data can be understood to be data including a respective mass spectrum of product ions resulting from fragmentation of each of multiple groups of precursor ions, each group of precursor ions having m/z values in a different m/z value window.

The apparatus may include display means for displaying the two dimensional mass spectrum data, e.g. on a 2D plot having a first axis corresponding to the m/z value of precursor ions (MS1 axis), and a second axis corresponding to m/z values of product ions (MS2 axis). Such a plot may be referred to as an MS1×MS2 spectrum.

Preferably, the control means is configured to, for each group of ions, store correspondence data which indicates, for each group of ions, the one or more selected potential wells in which that group of ions is transported along the transport channel by the transport potential, as well as the m/z values of precursor ions from which that group of ions was initially formed (e.g. in the form of data which indicates an m/z value representing the middle of the m/z value window corresponding to that group of ions). Such correspondence data would generally be needed in order to derive two dimensional mass spectrum data, or other more complex forms of mass spectrum data, from the mass spectra produced by the second mass analyser. The "more complex" forms of mass spectrum data referenced here might, for example, be mass spectrum data including mass spectra produced by the second mass analyser where the apparatus includes a preliminary analyser in addition to the first mass analyser (as described in more detail below).

The apparatus may have a group gathering means configured to receive each group of ions that is to be received by the ion transport device in a different respective time period, wherein a plurality of group gathering electrodes are positioned around a group gathering region of the group gathering means, wherein the control means is configured to control the voltages applied to the group gathering electrodes to, for each group of ions received by the group gathering means:

- temporarily generate a gathering potential in the group gathering region so that the group of ions received by the group gathering region is gathered in the group gathering region; and
- generate a potential in the group gathering region to introduce the ions to one or more selected potential wells of the transport potential in the transport channel.

In this way, each group of ions can be separately introduced to one or more selected potential wells of the transport potential in the transport channel.

An example group gathering means forming part of an ion transport device that could be used for this purpose is discussed for example in WO2018/114442, where the group gathering means is referred to as a "bunch forming region" of a ion transport device.

The group gathering means may include any of the optional features described in connection with the "bunch forming region" of WO2018/114442, the content of which is incorporated by reference herein.

Thus, for example, the gathering potential may include a potential well for gathering ions in the group gathering region. The potential well is preferably configured to axially confine charged particles relative to a longitudinal axis that extends along the transport channel.

Thus, for example, the potential well included in the gathering potential may be static.

Thus, for example, the gathering potential may include, e.g. in addition to the potential well, a radial confining potential, wherein the radial confining potential is configured to confine ions in a radial direction (e.g. radial relative to a longitudinal axis that extends along the transport channel) in the group gathering region. The radial confining potential may be an AC potential, e.g. an RF potential, e.g. an RF multipole field generated by applying an RF potential to electrodes of a multipole (RF=radiofrequency).

Thus, for example, the potential well may have an upstream potential barrier and a downstream potential barrier, wherein the upstream potential barrier is closer to an inlet of the ion transport device than the downstream potential barrier.

The group gathering means may conveniently be part of the ion transport device, with the group gathering electrodes being electrodes of the ion transport device, and with the group gathering region being a region within the ion transport device.

The group gathering means may alternatively be separate from the ion transport device, e.g. located upstream, preferably immediately upstream, of the ion transport device.

In the context of this disclosure, one component being described as "downstream" with respect to another component is intended to refer to that (downstream) component being configured to interact with ions after those ions have interacted with (e.g. passed through) the other (upstream) component. Similarly, one component being described as "upstream" with respect to another component is intended to refer to that (upstream) component being configured to interact with ions before those ions have some interaction with the other (downstream) component.

The control means is preferably configured to coordinate the operation of the first mass analyser, the group gathering means (if present), and the ion transport device, so that the ejection of groups of ions, the gathering of ions in a group gathering region (if the group gathering means is present), and the generation of the transport potential is coordinated such that each group of ions that is to be received by the ion transport device is respectively transported along the transport channel by the one or more selected potential wells in the transport potential. A skilled person could readily configure the control means to coordinate such operations, based on the present disclosure.

In some examples, the fragmentation means may include the first mass analyser. For example, the first mass analyser could be an ion trap configured to fragment the precursor ions whilst those precursor ions are being ejected from the ion trap. Thus, for the avoidance of any doubt, the group of ions may be partly or entirely composed of product ions by the time it is received by the ion transport device.

If the fragmentation means includes the first mass analyser, the first mass analyser may be an ion trap configured to fragment the precursor ions whilst those precursor ions are being ejected from the ion trap by ejecting the ions with adequately high kinetic energies so as to cause CID. As a skilled person would appreciate, this could be achieved, for example, by the ion trap having a raised buffer gas pressure, a raised value of Mathieu parameter q at which the ejection takes place and/or a raised strength of an excitation field for ejecting ions from the ion trap, compared with a case where precursor ions are to be ejected from an ion trap with minimal or no fragmentation (e.g. where it is desirable to fragment ions in another part of the apparatus, using CID or another fragmentation technique such as ECD, ETD or other techniques as described below).

Fragmenting precursor ions by CID whilst those precursor ions are being ejected from the ion trap as described above provides an advantage as compared to conventional CID that takes place within a conventional ion trap mass spectrometer (known as resonant CID), where the energy is typically limited by the need to retain the fragmented (product) ions. That is the excitation voltage, and the amount of energy deposited into a precursor ion is, in conventional CID, limited by the depth of the pseudo-potential used to retain ions in the ion trap (resonant CID typically involves applying an additional or supplementary AC voltage at frequency matching the secular frequency of ions that one wishes to eject).

In the case of fragmenting precursor ions by CID whilst those precursor ions are being ejected from the ion trap (as described above), the energy is not restricted in the same way, because the excitation takes place during the ejection of precursor ions (and any produced product ions) from the ion trap, e.g. through an ejection slit or other aperture. Similarly a high value of q may be chosen for the ejection, because a 'Low Mass Cut' restriction' does not apply. Note here that when resonant CID is undertaken in a conventional ion trap, for example in an $MS^n$ experiment (involving successive mass selection and resonant CID steps) a relatively low value of q must be chosen because the m/z of the production ions (lower than the m/z of the precursor ion) is given by $M_{LMC}/M_{precursor}=q_{eject}/q_{boundary}$; where $M_{LMC}$ is the m/z of the lowest m/z ion that may be retained in the ion trap, that is with ions of lower m/z not being stable; $q_{eject}$ is the Mathieu parameter q at which the ejection takes place and $q_{boundary}$ is the Mathieu parameter q at the boundary of the stability region, that the boundary at which ions having higher values are not stable and so are not trapped by the ion trap.

Higher values of a $q_{eject}$ result in the ejection of ions with higher energy—this because ions must overcome a higher pseudo-potential to escape the ion trap (pseudo-potential well depth is proportional to $qV_{RF}$ where $V_{RF}$ is the RF trapping voltage). In the present case the LMC does not apply because the selected precursor ions and the generated productions are all ejected together and a trapped within an external region in a manner that is described elsewhere.

In some examples, the fragmentation means may include a fragmentation device located downstream of the first mass analyser and upstream of the ion transport device.

For example, the fragmentation means may include ion optical elements in a region located between the first mass analyser and the ion transport device. The region in which the ion optical elements are located may be a focusing region as described below. The ion optical elements may be configured (e.g. through application of DC voltages to said ion optical elements) to accelerate ions to cause fragmentation of ions by CID. In this case the product ions may be formed before ions entering the ion transport device (preferably also before entering the group gathering means, if present).

In some examples, the fragmentation means include part of the ion transport device.

For example, the fragmentation means may include part of the ion transport device configured to fragment ions as they are transported through a fragmentation region of the ion transport device (by the transport potential), by any one or more known fragmentation techniques, such as CID, IRMPD, UVPD, HAD, NAD, OAD, ECD, ETD. Such techniques are well known and discussed in detail below.

In some examples, the part of the ion transport device configured to fragment ions as they are transported through a fragmentation region of the ion transport device is configured to fragment ions by one or more of UVPD, HAD, NAD, OAD, ECD or ETD. As discussed in more detail below, these fragmentation techniques are slow and can take several 10s of milliseconds or 100s of milliseconds to complete. Such techniques can be implemented by the present apparatus as described in more detail below.

Accordingly, in some examples, the apparatus could be configured to retain each group of ions in the fragmentation region for a relatively long time, e.g. 1 ms or more, or 10 ms or more, or 100 ms or more, e.g. so as to allow slower fragmentation techniques to be performed. If a long fragmentation period is necessary but it is desired to maintain throughput of the device, the throughput could be achieved by having a fragmentation region that is suitably long in length (see below).

If part of the ion transport device configured to fragment ions as they are transported through a fragmentation region of the ion transport device (as described above), the ion transport device preferably includes an ion cooling region, preferably located downstream (preferably immediately downstream) of the fragmentation region, wherein the apparatus is configured to cool ions as they are transported through the cooling region (by the transport potential).

If part of the ion transport device configured to fragment ions as they are transported through a fragmentation region of the ion transport device (as described above), the ion transport device preferably includes a pressure gradient region, preferably located downstream (e.g. immediately downstream) of the fragmentation region. The apparatus may include gas pressure reducing means (e.g. one or more differentially pumped chambers and gas flow restricting apertures) configured to reduce the gas pressure surrounding ions as they are transported through the pressure gradient region (by the transport potential). The pressure at an outlet end of the pressure gradient region may be a factor of 3 or more times lower than at an input end. The pressure at an outlet end of the pressure gradient region may be $10^{-3}$ mbar or lower.

Depending on the fragmentation technique being implemented (see above), the fragmentation region could be relatively long, e.g. 20 mm or longer, 30 mm or longer, or even 40 mm or longer, e.g. so as to allow slower fragmentation techniques to be performed whilst still allowing the apparatus to have a high throughput. A 40 mm fragmentation region may be required, for example, where the fragmentation technique implemented requires a 10 ms travel time in a device having a 1 kHz well rate and 4 mm wavelength.

An example of fragmentation being implemented by a fragmentation region in the ion transport device is described below with reference to FIGS. 4 and 5; in that example the fragmentation technique being implemented in the fragmentation region is CID.

If the fragmentation means includes part of the ion transport device configured to fragment ions as they are transported through a fragmentation region of the ion transport device (as described above), the fragmentation process may cause energy to be imparted to the ions within the potential wells, which may cause ions in each group to spill into adjacent wells.

Thus, it may be prudent for the apparatus to be configured to leave empty one or more potential wells on either side (preferably both sides) of the one or more selected potential wells respectively transporting each group of ions. In this way, any ions from a particular group of ions that is caused to spill into adjacent wells as part of the fragmentation process can avoid mixing with ions from other groups.

The ion transport device may include a group re-gathering region configured to receive each group of ions respectively transported along the transport channel by the transport potential in a different respective time period, wherein a plurality of group re-gathering electrodes are positioned around the group re-gathering region, wherein the control means is configured to control the voltages applied to the group re-gathering electrodes to, for each group of ions received by the group re-gathering region:

temporarily generate a gathering potential in the group re-gathering region so that the group of ions received by the group gathering region is re-gathered in the group re-gathering region; and generate a potential in the group re-gathering region to introduce the ions to back to the one or more selected potential wells of the transport potential in the transport channel.

Such a re-gathering region may be useful to put ions back in their originally intended one or more selected potential wells, e.g. if a fragmentation process implemented in the ion transport device (see above) causes ions in each group to spill into adjacent wells. The group re-gathering region can readily be implemented using the teaching and principles described in WO2018/114442.

The group re-gathering means may include any of the optional features described in connection with the "bunch forming region" of WO2018/114442, or the group gathering means described above.

The first mass analyser may include an ion trap. The ion trap may be a linear ion trap. The first mass analyser may include multiple ion traps.

According to the first aspect of the invention, the first mass analyser is configured to, when ejecting each group of ions, retain at least some of any other ions contained in the first mass analyser prior to the group of ions being ejected.

Techniques for selectively ejecting multiple groups of ions from a mass analyser in a predetermined sequence such that each group of ions is ejected during a different time window and is formed from precursor ions having m/z values in a respective m/z value window, and in a manner that retains at least some of (preferably substantially all of) any other ions contained in the first mass analyser prior to that group of ions being ejected are well known. Such techniques may, for example, involve the well-known process of resonant ion ejection, see e.g. U.S. Pat. No. 6,770,871: U.S. Pat. No. 7,507,953, Chapter 4 from "Practical Mass Spectrometry Volume 1", Raymond E. March and John F. J. Todd. Preferably, a digital ion trap is used, e.g. as disclosed in "A digital ion trap mass spectrometer coupled with atmospheric pressure ion sources" (Ding et al, J Mass Spectrom, May 2004, 39(5); 471-84).

Ions may also be ejected in the axial direction from a linear ion trap, a process known as mass selective Axial Ion Ejection, as described in "A new linear ion trap mass spectrometer" (Hager, Rapid Communications in mass spectrometry, 2002, 16, 512-526). This type of ejection could be used in the first mass analyser of the present invention, for example.

Each m/z value window may be less than 10Th wide, more preferably less than 5Th wide, more preferably less than 2Th wide. Each m/z value window may conveniently be approximately 1Th wide. Wider or narrower m/z value windows are also possible. Adjacent windows may be spaced apart from each other, e.g. by a small amount, e.g. so as to avoid overlapping windows.

Each time window is preferably 10 ms or shorter, more preferably 1 ms or shorter, and could be 0.5 ms or shorter.

Narrow m/z value windows (preferably ~1 Th wide) and wide time windows may help to maximise the amount of information obtained, but lengthen the analysis time. An example is given in the detailed description, below.

Reference may be made in this description to "well rate", meaning the rate at which potential wells are moved past a fixed location along the transport channel (e.g. as measured in units of Hertz). If each group of ions is received by a single selected potential well, with no unoccupied wells sitting between the occupied potential wells, then the well rate should be $1/w_t$ or lower, where $w_t$ is the width of the time windows (in units of seconds). Clearly, if each group of ions is received by multiple selected potential wells, or potential wells are left empty between the selected potential wells in which ions are received, then the relationship between well rate and $w_t$ could be different.

The apparatus may include one or more ion focussing electrodes configured to focus each group of ions towards an axis of the apparatus, e.g. located in a focusing region between the first mass analyser and the ion transport device. For avoidance of any doubt, the axis need not be a straight line and could e.g. include one or more curved region.

Preferably, the multiple groups of ions are ejected in a predetermined sequence. Conveniently, in this predetermined sequence, the m/z value window of each group may be incrementally higher or lower than the previous group, but other sequences are possible. It is also possible to selectively eject precursor ions in predetermined mass windows when a priori information about the ions is available (e.g. in a targeted analysis). The ion transport device (and if present the group gathering region) preferably receives the groups of ions separately, and in the predetermined sequence.

The ion transport device preferably includes a plurality of extraction electrodes, wherein the control means is configured to control the extraction electrodes to generate an extraction potential configured to extract each group of ions from the transport channel when the one or more selected potential wells carrying that group of ions reaches one or more extraction regions of the transport channel.

The second mass analyser may be configured to produce a respective mass spectrum using each group of ions after it has been extracted by the extraction electrodes.

The extraction potential may be configured to extract each group of ions out of the ion transport device through an outlet of the ion transport device in a direction that is non-parallel (preferably substantially orthogonal) to an axis that extends along the transport channel. Arrangements for achieving this are described, for example, in WO2018/114442.

One issue identified by the inventors in connection with orthogonal extraction is that, in some embodiments it may be difficult to extract ions from a single target potential well, without disrupting/extracting ions in adjacent potential wells.

Thus, for this type of extraction, it may be prudent for the apparatus to be configured to leave empty one or more potential wells on either side (preferably both sides) of the one or more selected potential wells respectively transporting each group of ions. In this way, orthogonal extraction of one group of ions can more easily avoid disrupting/extracting other groups of ions.

However, the extraction potential need not be configured to extract each group of ions out of the ion transport device through an outlet of the ion transport device in a direction that is orthogonal to an axis that extends along the transport channel. For example, the extraction potential may be configured to extract each group of ions out of the ion transport device through an outlet of the ion transport device in a direction that is parallel to a longitudinal axis that extends along the transport channel.

The second mass analyser is preferably a time of flight ("ToF") mass analyser. The extraction potential (if extraction electrodes are present—see above) may be configured to extract each group of ions into the ToF mass analyser.

The transport channel may include one or more extraction regions. The/each extraction region may be located within the transport region of the transport channel. In this way, charged particles can be transported in bunches to the/each extraction region.

The apparatus may include a preliminary analyser, upstream of the first mass analyser, wherein the preliminary analyser is configured to eject groups of ions to be delivered to the first mass analyser in a predetermined sequence. This may result in more complex forms of mass spectrum data, as noted above.

The preliminary analyser may include a third mass analyser configured to eject groups of ions to be delivered to the first mass analyser in a predetermined sequence such that each group of ions ejected by the third mass analyser is ejected during a different time window and is initially formed from ions having m/z values in a respective m/z value window, wherein the first mass analyser is configured to receive each group of ions ejected by the third mass analyser.

In one example, the third mass analyser could be an ion trap configured to store fragments of complicated molecular ions, and eject them in groups of ions such that each group of ions ejected by the third mass analyser is ejected during a different time window and is initially formed from ions having m/z values in a respective m/z value window.

In one example, the third mass analyser (either alone or in conjunction with the first mass analyser) could be configured to perform N rounds of mass selection and fragmentation, where N is an integer value that is 1 or greater, before the product ions resulting from the N rounds of precursor mass selection are ejected in groups from the first mass analyser. This way, the precursor ions in first mass analyser may be product ions resulting from N preceding rounds of mass selection and fragmentation.

By way of example, the third mass analyser could be configured to eject groups of MS1 ions from the third mass analyser (each group of MS1 ions ejected by the third mass analyser being ejected during a different time window, and being initially formed from MS1 ions having m/z values in a respective m/z value window), so that each group of MS1 ions ejected by the third mass analyser is delivered to the first mass analyser for fragmentation in the first mass analyser (one preliminary round of mass selection and fragmentation, i.e. N=1) to produce MS2 ions. The MS2 ions resulting from each group of MS1 ions could then be processed by the first mass analyser, the ion transport device and the second mass analyser as described above, thereby performing a further round of mass selection and fragmentation. In this case, there could be displayed three dimensional mass spectrum data, with a first axis for the m/z values the groups of MS1 ions ejected by the third mass analyser, a second axis for the m/z values of the groups of MS2 ions ejected out of the first mass analyser, and a third axis to show the mass spectra of the MS3 ions resulting from fragmentation of each group of MS2 ions.

In another example, the third mass analyser could be an ion trap configured to eject groups of precursor ions within a limited, but relatively wide mass range, e.g. 100 Th, as taught by U.S. Pat. No. 7,507,953. In this example, ions could be processed by the first mass analyser in portions, thereby improving its performance by reducing the space charge density of ions in the first mass analyser. For example, the third mass analyser might hold more ions, without having the same resolution requirements as an ion trap acting as the first mass analyser. For example, if the m/z window being studied was 500 to 1000 Th and the third mass analyser passed ions to the first mass analyser in mass windows of 50 Th, then the first mass analyser could hold 10 times more ions in each window compared to a situation in which the first mass analyser had to hold ions in the 500 Th to 1000 Th range at once.

Several ion traps could be arranged in a similar way for consecutive narrowing of the mass range, thereby increasing the overall space charge capacity provided (collectively) by the ion traps and reducing the space charge density of ions in each downstream ion trap.

Other forms of preliminary analysers (other than mass analysers) are possible. For example, the preliminary analyser may be an ion mobility spectrometer, a differential mobility analyser, or a chromatography device such as a liquid chromatograph or a gas chromatograph. The preliminary analyser may be configured to select the charge state of ions, or to convert the charge state of ions to a single charge state, for example to all be singularly charged ions.

The first mass analyser, ion transport device, control means, fragmentation means, and second mass analyser may be configured to process each precursor group of ions in a manner described above.

In a first set of examples, the apparatus may include just one first mass analyser and one ion transport device, wherein the ion transport device is configured to receive each group of ions ejected from the first mass analyser. This is the arrangement adopted in all of the examples described in the detailed description, below. However, as the following other sets of examples will demonstrate, it is not necessary for an ion transport device to receive all groups of ions from a first mass analyser, since different groups of ions from a first mass analyser may be directed to different ion transport devices.

In a second set of examples, the apparatus may include multiple ion transport devices, wherein each ion transport device has a plurality of electrodes arranged around a transport channel, wherein the transport channel of each ion transport device is configured to receive a respective subset of groups of ions ejected from the first mass analyser.

In this second set of examples, the apparatus may include multiple group gathering means, wherein each group gathering means is configured to, for a respective one of the ion transport devices, receive each group of ions that is to be received by that ion transport device in a different respective time period. Each group gathering means may be configured as described above, e.g. with a plurality of group gathering electrodes positioned around a group gathering region of the group gathering means, wherein the control means is configured to control the voltages applied to the group gathering electrodes to, for each group of ions received by the group gathering means:

temporarily generate a gathering potential in the group gathering region so that the group of ions received by the group gathering region is gathered in the group gathering region; and generate a potential in the group gathering region to introduce the ions to one or more selected potential wells of the transport potential in the transport channel.

In this second set of examples, the apparatus may include multiple second mass analysers, wherein each second mass analyser is configured to produce a mass spectrum using each group of ions transported along the transport channel of a respective one of the ion transport devices. Alternatively, a single second mass analyser may be used to analyser ions transported by all of the ion transport devices.

In this second set of examples, the control means may be configured to control voltages applied to the electrodes of each ion transport device as described previously.

In this second set of examples, the apparatus may have multiple group gathering means, wherein each group In this second set of examples, each of the multiple ion transport devices could be configured as described previously. For example, the fragmentation means may include part of each ion transport device, wherein part of each ion transport device is configured to fragment ions as they are transported through a fragmentation region of that ion transport device (by the transport potential), e.g. using any one or more known fragmentation techniques.

An advantage of the second set of examples over the first set of examples is that the throughput and sensitivity of the apparatus could be improved, since in an apparatus where there is only one ion transport device, there may need to be time gaps between ejections from the first mass analyser, so that each ion group can be gathered and transported away before the next group arrives. Such time gaps could be reduced/avoided if there are multiple ion transport devices, as whilst one group of ions is being gathered at one ion transport device, another ion transport device may be configured to receive the next group of ions.

In a third set of examples, the apparatus may include multiple first mass analysers and multiple ion transport devices, wherein each first mass analyser is configured to eject a respective group of ions which is received by a respective one of the ion transport devices, and processed in an above described manner. There may be multiple second mass analysers, wherein each second mass analyser is configured to produce a respective mass spectrum using each group of ions after it has been fragmented by the fragmentation means and transported along a respective one of the transport channels.

In this third set of examples, following further improvements could be achieved: Using a preliminary mass analyser (e.g., ion trap), precursor ions could be divided into different mass windows so that each of the first mass analysers receives ions in a different mass window, e.g. so as to speed up the experiment and reduce the space charge; Using a preliminary mass analyser (e.g., ion trap), precursor ions in the same mass window could be divided into multiple (e.g. equally sized) portions to be received by each first mass analyser, e.g. so as to increase the charge throughput.

The invention also includes any combination of the aspects and preferred features described except where such a combination is clearly impermissible or expressly avoided.

SUMMARY OF THE FIGURES

Embodiments and experiments illustrating the principles of the invention will now be discussed with reference to the accompanying figures in which.

DETAILED DESCRIPTION OF THE INVENTION

Figure 1:
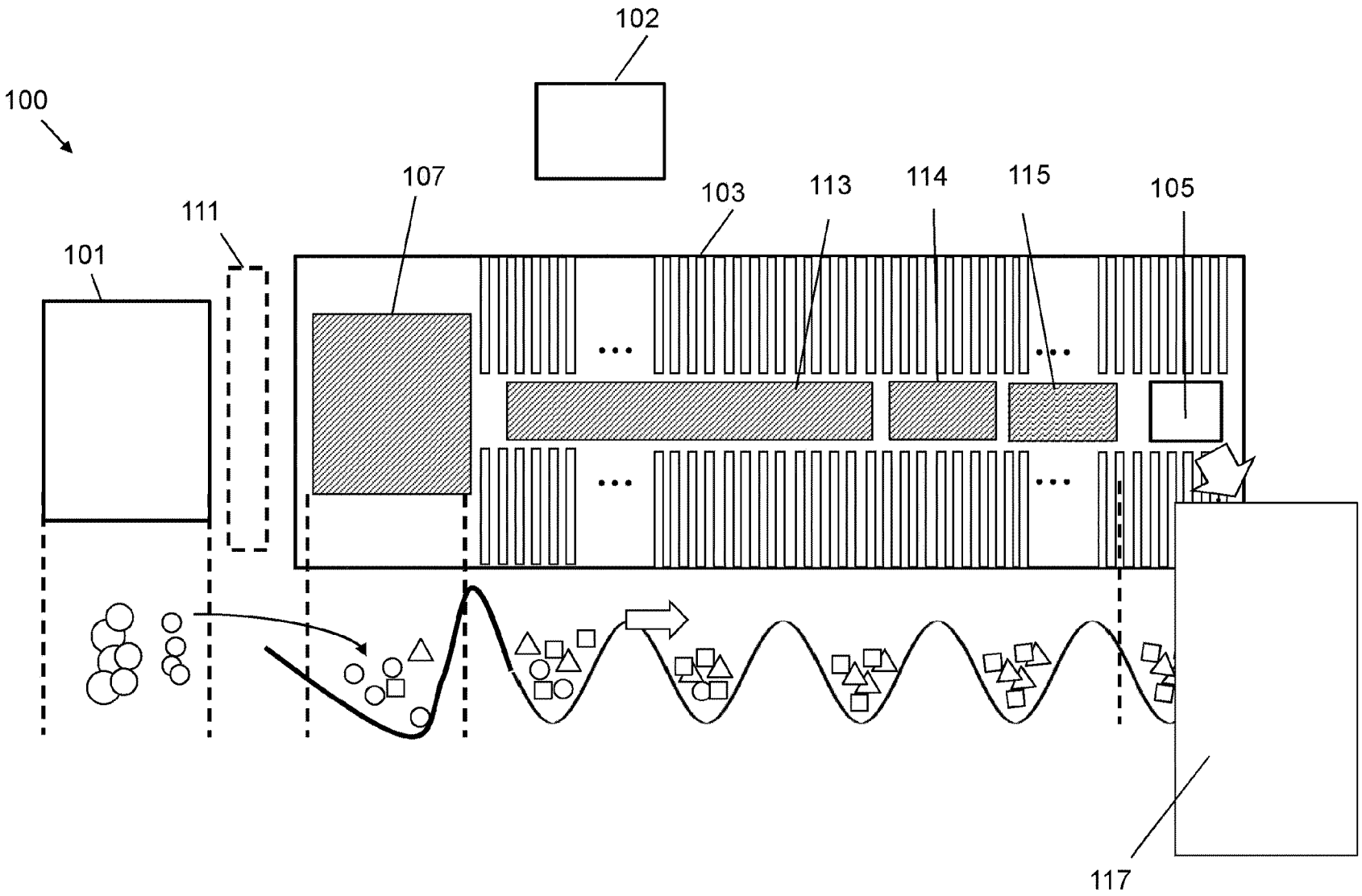
FIG. 1 is a schematic representation of an example apparatus for analysing ions.

In general terms, we will set out an apparatus and corresponding method which seek to implement one or more aspects of the present invention.

Advantages of the disclosed apparatuses and methods may include:

- Near lossless production of two dimensional mass spectrum data. Here the term "near-lossless" refers to the production of two dimensional mass spectrum data in a manner that preferably substantially avoids the loss of precursor ions. This is contrasted with conventional MS/MS techniques which tend to involve discarding significant numbers of precursor ions (those ions that are not selected for analysis) each time precursor ions are selected.
- Creating two dimensional mass spectrum data covering wide m/z range of precursor and product ions acquired at a higher rate and in a manner that is compatible with liquid chromatography methods, offering a massive improvement in sensitivity and information content compared to all prior art methods.
- The two dimensional mass spectrum data produced by the apparatuses and methods taught herein are expected to contain fewer interferences and, therefore, assist with improving the identification of precursor ions.
- Potentially accommodation of many fragmentation methods including "slow" fragmentation methods, for example electron transfer dissociation (ETD) and hydrogen attachment/abstraction dissociation (HAD), whilst still providing adequate throughput to generate two dimensional mass spectrum data in an improved timeframe.

The fragmentation methods disclosed herein are believed to provide better structural information (e.g. providing backbone cleavages of peptides and thus preserving PTM information) and/or be applicable to fragmentation of intact proteins, and some can be relevant to the singularly charge peptides. A major limitation of these 'slow' fragmentation methods is that as they are slow, they severely limit the throughput and thus application in prior art MS/MS devices.

Example apparatuses described below may include an ion trap and a bunching device which are combined and synchronised.

Example apparatuses described below may include any one or more of the following features:

- a means to mass selectively eject a precursor ion species of a single m/z value, e.g. an ion trap
- an ion transport device capable of transporting ions which have a wide mass range in bunches
- the ion transport device may be configured to have a high residence time for the transported ions, a group gathering means (which may also be referred to as a selective bunch injection means) may be used to receive precursor ion species from an ion trap and place them into a selected potential well provided by the ion transport device the ion transport device may be configured to deliver ion bunches at a high repetition rate to a downstream device such as a ToF analyser Fragmentation means may be used to fragment the precursor ions, which may be effective prior to ions being transported by the ion transport device (noting that precursor ions may be fragmented during the resonance ejection process and thus before they leave the ion trap) and/or whilst ions are being transported by the ion transport device The ion transport device may be configured to deliver ions into a high vacuum region, or ultra-high vacuum region with substantially thermal energy.

The present invention was devised in view of development work done in connection with the A-device mentioned in the background section, and can be viewed as employment of A-device for an MS/MS system providing for, in the words of the inventors, a 'quantum leap' in performance compared to existing commercial MS/MS devices. Note: Although there is mention of fragmentation to improve the throughput of Q-ToF and Q-q-Q MS methods on page 91 line 22 to page 92 line 18 of WO2012/150351, there is no disclosure/suggestion in WO2012/150351 of using the A-device in accordance with the presently claimed invention.

Aspects of the present disclosure believed to be novel include:

Inserting a travelling pseudo-potential wave ion transport device (preferably the above-referenced A-device) between an first mass analyser (e.g. ion trap) and a second mass analyser (e.g. ToF analyser)

Mass selectively ejecting precursor ions from the ion trap in a time sequence.

Trapping the mass selected precursor ions into a single selected pseudo-potential well of the travelling pseudopotential wave in the ion transport device Fragmenting the precursor ions as they travel along the travelling pseudopotential wave ion guide Synchronising the resonant ejection time windows of the ion trap with travelling pseudopotential wave ion guide (A-device)

Here it is to be noted that:

Injection of ions from the ion trap is preferably coordinated with, e.g. synchronised in time, to the transporting of ions in the ion transport device The selected potential well used to transport a given group of ions may be used to identify the precursor ion mass, or m/z value window, of ions in that group.

A suitable injection method for placing a group of ions in a single targeted pseudopotential well of the travelling pseudo-potential wave ion guide is outlined in WO2018/114442

Fragmentation of the precursor ions travelling inside a pseudo-potential wave ion guide (preferably A-device) may be used to obtain two dimensional mass spectrum data in a near-lossless manner.

An extended time for fragmentation of the precursor ions may be permitted by the techniques taught herein. This has important consequences and advantages, because it allows implementation of known 'slow' methods of ion fragmentation (dissociation), but at the same time delivers ions for mass analysis at a high throughput. These methods are known to provide selective backbone cleavages, advantageous for identification of PTMs (post translational modifications) in proteins. Note it is now known that the majority of proteins undergo post translation modifications within biological systems, so PTM localisation is generally needed for all biologically relevant proteomic studies.

Thus product ions derived from the individual mass separated precursor ions may be analysed directly, that is the product ions of a wide mass range can be analysed by a single ToF analysis. Thus the ToF analysis is also synchronised with the progression of the pseudo-potential wells of the abovementioned A-device. As a consequence: (i) A near 100% duty cycle can be achieved (unlike in the prior art systems); (ii) The time needed by the ToF mass analyser does not need to be much shorter than the arriving ions groups, and so the ToF analyser does not need to be scanned at a very high rate, as is necessary by prior art—this gives the present invention opportunity to be employed with a ToF system that has long flight time, and thus can achieve a high resolving power in the mass spectra.

Aspects and embodiments of the present invention will now be discussed with reference to the accompanying figures. Further aspects and embodiments will be apparent to those skilled in the art. All documents mentioned in this text are incorporated herein by reference.

A general embodiment of the invention for fragmentation of ions in the disclosed system for lossless tandem mass spectrometry is shown in FIG. 1.

In FIG. 1, there is shown an apparatus 100 for analysing ions including a first mass analyser 101, an ion transport device 103, and a control means 102.

The control means 102 may e.g. take the form of a general purpose computer, or a dedicated real time computer, and may include firmware such as a dedicated FPGA based processor.

The first mass analyser 101, which in this example takes the form of an ion trap 101, preferably a linear ion trap ("LIT"), is configured to eject groups of ions in a predetermined time sequence such that each group of ions is ejected during a different time window and is initially formed from precursor ions having m/z values in a respective m/z value window, wherein the ion trap 101 is configured to, when ejecting each group of ions, retain at least some of any other ions contained in the first mass analyser prior to the group of ions being ejected. In this case, the ion trap 101 is configured to eject the groups of ions by resonant ejection (a known technique), into a group gathering means 107.

The ion transport device 103 has a plurality of electrodes arranged around a transport channel, wherein the transport channel is configured to receive each group of ions ejected from the ion trap 101.

The resolution of ion ejection from the ion trap 101 is preferably configured to eject, at different times, groups of precursors having m/z values separated by 1Th, whilst retaining substantially any other ions in the ion trap 101. That means it is desirable that a group of ions having m/z values of M Th is ejected in one time window whilst ions having m/z values of M+1 Th remain in the ion trap 101. The ejected ions may pass through a region of ion optical elements 111 before reaching the group gathering means 107 (which may also be referred to as an 'ion injection unit' or 'bunch forming region'). The role of the ion optical elements 111 may be to reduce/increase the energy and/or focus ions towards an ion optical axis of the device. In preferred embodiments the ion trap 101 operates at relatively low gas pressure (e.g. ~$10^{-4}$ mbar), compared to the pressure in ion optical elements 111 and the group gathering means 107. In this example, fragmentation of ions during the ejection of ions from the ion trap 101 into the group gathering means 107 may be avoided. To achieve this, the value of q (Mathieu parameter) of ions ejection from the ion trap 101, and the gas pressure and species in the group gathering means 107 may be adjusted appropriately. For example, Helium gas may be used in the ion trap 101 as the buffer gas, and Argon or Helium gas in the pressure range $10^{-2}$ to $10^{-3}$ mbar may be used in the group gathering means 107. Ejection slit(s) of the ion trap 101 may provide gas restricting diaphragm(s) and/or a gas restricting aperture may be employed in focusing region 111 in some embodiments. The group gathering means 107 may be an integral part of the ion transport device 103, as is the case in this example.

An example group gathering means forming part of an ion transport device that could be used to gather precursor ions of the same m/z (or relatively narrow m/z window) mass selectively ejected from the ion trap 101 and is an integral part of an ion transport device 103 is discussed for example in WO2018/114442, where the group gathering means is referred to as a "bunch forming region" of an ion transport device.

The group gathering means 107 can thus be considered as a bunch forming region of the ion transport device, and could also be considered as an injection region.

At the first part of a cycle performed by the group gathering means 107, there may be a gathering potential generated that confines and cools the ions in a group gathering region (e.g. at a predetermined axis location centred on an axis of the ion transport device) of the ion transport device 103. In a second part of the cycle a transport potential is generated in the group gathering region for transporting ions from the group gathering region 107 in a selected well along the transport device 103. The potential in the second part of the cycle preferably has the same form of potential well inside the ion transport device 103, which normally would be permanently present in other regions of the ion transport device 103 (when the apparatus is operating). Such techniques have already been disclosed in WO2018/114442.

In this example, the apparatus 100 includes fragmentation means configured to fragment precursor ions in each group of ions so as to produce product ions. In this example, the fragmentation means includes part of the ion transport device configured to fragment ions as they are being transported through the fragmentation region 113 of the ion transport device 103

In the fragmentation region 113, precursor ions may be dissociated to produce product ions, whilst simultaneously being transported within the ion transport device 103 by the moving potentials wells. The group of ions, including both the precursor ions and any resulting product ions preferably stay within the same selected potential well as they exit the ion fragmentation region 113. Product and precursor ions may then pass into an ion cooling region 114 of the ion transport device, so as to re-cool ions such that they reach thermal equilibrium with a buffer gas. Optionally and advantageously the buffer gas within ion cooling region 114 may be cooled to a sub ambient temperature. Ion cooling region 114 is a region of ion transport device 103 where precursor ions and produced product ions are simultaneously transported and cooled whilst residing in a single potential well. Product and precursor ions may then optionally and advantageously pass into a pressure gradient region 115 (or 'differential pressure region') of the ion transport device 103. The apparatus 100 may include one or more differentially pumped chambers and gas flow restricting apertures configured to reduce the gas pressure surrounding ions as they are transported through the pressure gradient region (by the transport potential). The buffer gas within pressure gradient region 115 may optionally and advantageously be cooled below ambient temperature. The pressure at the outlet end of gradient region 15 may be a factor of 3 or more times lower than at the input end, and may be $10^{-3}$ mbar or lower.

The ion transport device 103 preferably includes a plurality of extraction electrodes (not shown), wherein the control means 102 is configured to control the extraction electrodes to generate an extraction potential configured to extract each group of ions from an ion extraction region 105 of the transport channel when the selected potential well carrying that group of ions reaches the extraction region 105 of the transport channel.

In this example, the extraction potential is configured to extract each group of ions out of the ion transport device 103 through an outlet of the ion transport device in a direction that is non-parallel (preferably orthogonal) to an axis that extends along the transport channel.

A second mass analyser 117, which is preferably a ToF mass analyser, is configured to produce a respective mass spectrum using each group of ions after it has been extracted by the extraction electrodes, so as to permit generation of two dimensional mass spectrum data (e.g. with each mass spectrum produced by the second mass analyser 117 providing data along an MS2 axis of a 2D plot).

With further reference to FIG. 1 there is an ion fragmentation region 113. This is for generating the product ions. Region 113 may be a small part of or substantially occupy the majority of the length of ion transport device 103. There may be a second bunch forming region 114 located within 103, and after 113. This may be used if the fragmentation method increases the kinetic energy of the precursor ions, which results in energetic product ions. This may result in the spreading of the ions into several bunches. The second bunch forming region prevents this happening. An example is CID, where the precursor may be excited by acceleration along the axis within the fragmentation region 113.

In this example, the part of the ion transport device configured to fragment ions as they are being transported through the fragmentation region 113 of the ion transport device 103, may be configured to fragment ions by any one or more known fragmentation techniques, which could include a slow fragmentation technique such as electron capture dissociation (ECD) and electron transfer dissociation (ETD), and other known techniques such as Hydrogen Attachment Dissociation (HAD), Oxygen Attachment Dissociation (OAD) and Nitrogen Attachment Dissociation (NAD), Ozone ID.

Using these 'slow' methods, it typically takes time for the reaction to take place and the product ions to form, e.g. 1-10 ms or even 100s of milliseconds. The latter methods are relatively easy to implement as they involve introducing neutral gaseous atoms or molecules into fragmentation region 113. These methods typically do not increase the kinetic energy of ions substantially and so the product and thereby allow precursor ions to remain in a single bunch within the ion transport device. These fragmentation methods also allow for Post Translational modifications (PTMs) of proteins to be discovered (note that at least 90% of proteins undergo post translation modifications, so PTM localisation is needed for most biologically relevant proteomic studies). Other ion fragmentation methods are also applicable such as those which introduce energy by photons in the IR or UV region, these methods are known in the art as IRMPD and UVPD.

As ions can remain in the same ion bunch captured within the same potential well, they can travel in the ion transport device for a prolonged residence time. The residence time may be tailored to the dissociation method/methods employed. Residence time may be achieved by adjusting the propagation of the potential wells through the ion transport device 103 (which as noted above is preferably an A-device implementing pseudo-potential wells), or the length of the ion transport device 103. Preferably, the residence time of ions in the ion transport device 103 would be in the range of tens to hundreds of milliseconds, e.g. 10 ms to 1000 ms. The propagation of the pseudopotential wells in an A-device can readily be controlled by setting the modulation frequency accordingly. A lower modulation frequency will provide a longer residence time, but also resulting in a lower frequency of ion bunches to the second mass analyser. A longer device will achieve a longer residence time and still maintain the throughput (rate of ion packet delivery to the ToF analyser).

A good dissociation yield can be reached without loss in transmission or mass range of the daughter ions, contrary to the prior art.

The second mass analyser 117 may be used to measure the mass spectra of each group of ions extracted from the ion transport device 103. The second mass analyser 117 is only shown in schematic form in FIG. 1, as such devices are well known. The extraction electrodes noted above preferably form part of the second mass analyser 117. Ion extraction electrodes are preferably capable of extracting ions from the extraction region 105 at a particular phase of the RF voltage, and to provide suitable spatial and temporal properties for extraction into the second mass analyser 117. Preferred embodiments of extraction region 105 are described in WO2012/150351, which provides the extraction of ion bunches in a direction orthogonal to the axis of ion transport device 103.

In some embodiments, the fragmentation means may include the ion trap 101 (either in addition to or as an alternative to the part of the ion transport device 103 configured to fragment ions as they are being transported through the fragmentation region 113 of the ion transport device 103). In this case, the ion trap 101 may be configured to perform CID before ions leave the ion trap 101. To achieve this, any one or more of the buffer gas pressure in the ion trap 101, the value of q (Mathieu parameter) and the strength of an excitation field for ejecting ions from the ion trap 101 may all be appropriately increased. This can provide high energy ion ejection, thereby resulting in high energy CID. This leads to an advantage as compared to conventional CID in a conventional ion trap mass spectrometer, where the energy is typically limited by the need to retain the fragment ions. In the present case the energy is not restricted. High energy CID results in the production of a wider distribution of fragment ions, and particularly a higher abundance of lower mass fragments. This is particularly useful in the fragmentation of higher mass precursor ions. In embodiments where CID is to be achieved during the ejection process it may be preferable to place ion optical elements between the ion trap 101 and ion transport device 103 to assist in collecting the fragment ions and slowing them down before they reach the ion transport device 103. This method has further advantages compared to the conventional ion trap mass spectrometer, as low mass cut (LMC) is not an issue. That is the LMC is extended to lower masses, thus the mass range of fragment ions can be extended.

In some embodiments, the fragmentation means may include ion optical elements in the focusing region 111 (either in addition to or as an alternative to the part of the ion transport device 103 configured to fragment ions as they are being transported through the fragmentation region 113 of the ion transport device 103). In this case, the ion optical elements in the focusing region 111 may be configured to cause fragmentation of ions by CID by applying DC voltages to said ion optical elements so as to accelerate ions. In this configuration the product ions may be formed before entering the ion transport device 103 and before entering the group gathering means 107.

In other embodiments (not shown), ion extraction electrodes may instead be configured to extract ion groups from an extraction region in a direction parallel to the axis of the ion transport device 103. Parallel extraction need not be pulsed, which may avoid a requirement to leave empty wells adjacent to a target well to be emptied (whereas in some examples, orthogonal extraction might require empty wells to be left adjacent to a target well).

The second mass analyser 117 may be capable of recording the mass spectrum of all the ions contained in an ion group before the next bunch to be analysed arrives in the ion extraction region 105. It is noted that it may be convenient in some embodiments of ion extraction region 105, not to place ions in every available potential well in the ion transport device 103, which may be achieved by means of the group gathering means 107. In preferred embodiments the second mass analyser 117 may be a Time of Flight ("ToF") analyser. The rate of ion bunch delivery to the extraction region 105 of this mass analyser may be defined by the modulation frequency of the ion transport device 103, when the ion transport device is an A-device. The typical modulation frequencies for a ToF analyser could be 0.2-16 kHz. A modulation frequency of 1 kHz could deliver an ion group to the second mass analyser 117 at time intervals of 500 μs. If the precursor ions are not placed in every available pseudopotential well of the transport potential generated by the ion transport device 103, the frequency delivery of ion delivery would be reduced. For example if the modulation frequency were 2 kHz and precursor ions were placed in every fifth available pseudopotential well of the ion transport device 103, then the ion delivery rate to the second mass analyser 117 would effectively be 2 kHz. The control means 102 is preferably configured to coordinate operation of the various components, e.g. such that operation of the second mass analyser 117 is synchronised with the operation of the ion transport device 103. More specifically, the extraction pulses should be synchronised with delivery of groups of ions to the extraction region and, preferably, with the phase space orientation of the ion groups (this relates to the phase of RF voltage as noted above). For an A-device, the extraction pulse should be synchronised with both the modulation and voltage waveforms. It should be noted that the same phase of voltage waveform is preferably used for all the phases of the transport waveforms of A-device.

The second mass analyser 117 could be a high resolving power ToF analyser. The analyser may be, for example, an electrostatic trap or multi-turn ToF analyser. The modulation frequency may be adjusted to match the type of analyser employed. Ions may be extracted from the ion transport device in an axial or radial (orthogonal) directions with respect to the axis of the device.

The apparatus 100 of FIG. 1 may be capable of analysing all ions within a group of ions (that is all masses of product ions) to provide a single mass spectrum of the entire population of ions within a single ion bunch transported and fragmented within ion transport device 103 by a single extraction event.

The apparatus 100 of FIG. 1 may be configured to provide near lossless two dimensional mass spectrum data on a chromatographical timescale in combination with high precursor and product mass range and resolving power and at high sensitivity (low limit of detection).

This apparatus 100 may provide ultimate data independent mass analysis, providing the capability for high clarity back bone cleaved spectra of multiple peptides in a mixture of many peptides without conventional losses in the mass isolation step, at a substantially 100% duty cycle. The apparatus 100 could allow more weakly expressed proteins with post translational modifications (PTMs) to be discovered than hitherto was possible.

In subsequent figures, alike reference numerals have been used to describe features in common with earlier figures. Such features may not be described in further detail, except where necessary, e.g. to highlight differences from previous examples.

Figure 2:
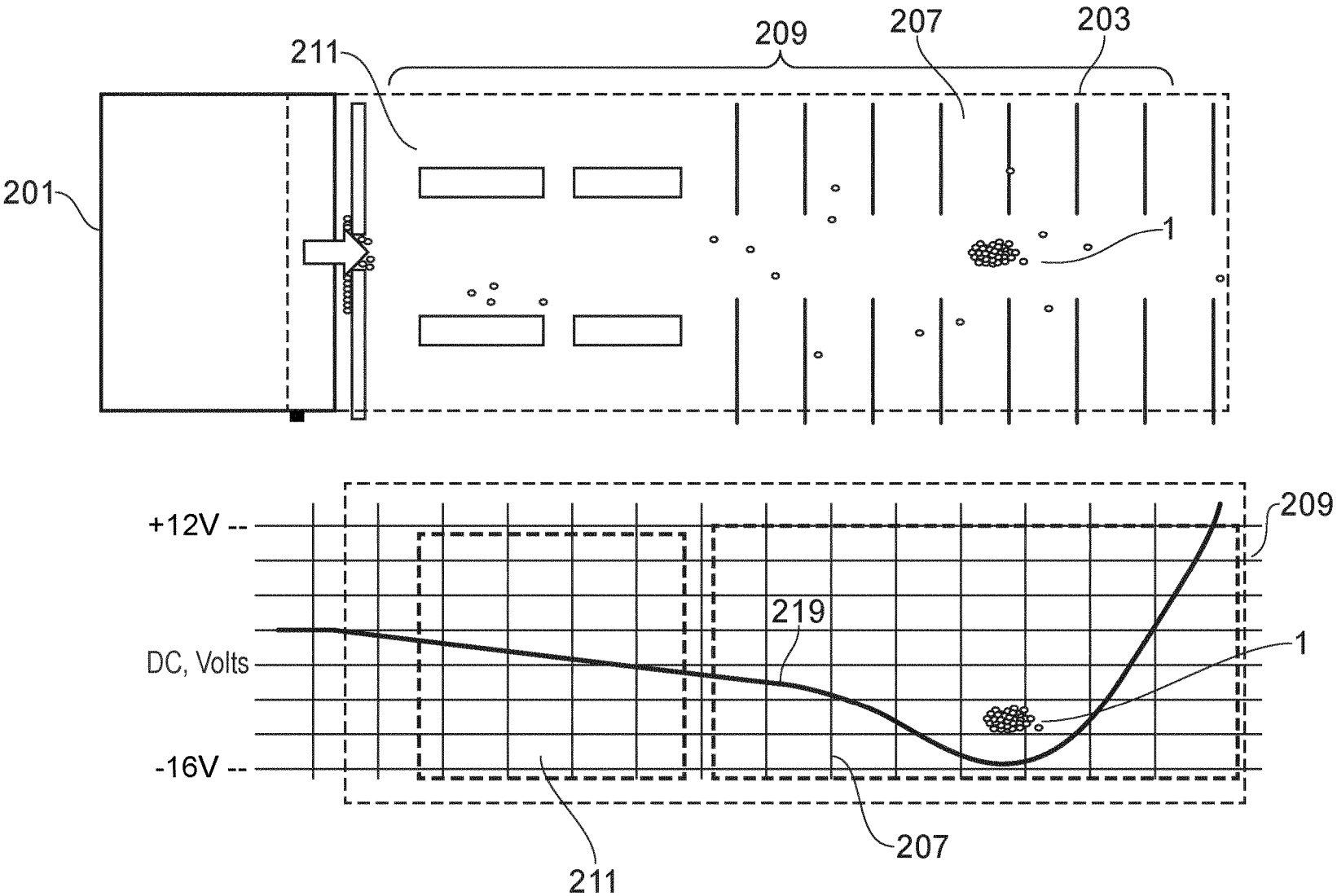
FIG. 2 shows an arrangement used to simulate an apparatus 200 implementing the apparatus 100 shown in FIG. 1.

FIG. 2 shows an arrangement used to simulate an apparatus 200 implementing the apparatus 100 shown in FIG. 1.

In this simulation, ions were stored in ion trap 201 and were mass selectively ejected from the ion trap 201 by resonant ejection into an ion transport device 203. In this example a single linear ion trap was simulated. Ions were ejected orthogonally from the LIT by means of resonant ejection (the ejection of ions from LIT by the means of resonant ejection is well known, it is used widely in commercial ion trap instruments). In the example shown ions ejected from the LIT pass through a pair of RF multipoles, effective for confining ions towards the axis of the ion transport device 203. Factors affecting the resolution of ion ejection are: the accuracy of the LIT, the correction or balancing of high order multipole components (high order field components arise from the existence of extraction slit or other geometry simplifications), scan speed and gas pressure. There are various methods for constructing ion traps and correcting field components is well known in the art. Spectral resolving powers of up to 30 k have been achieved. Slower scan speeds provide a higher resolution of ion ejection.

FIG. 2 also shows a DC profile 219 that may be applied along the axis within a focusing region 211 and a group gathering region 207. The DC profile, 219 may also be referred to as a gathering potential. The focusing region 211 and the group gathering region 207 together can be viewed as an injection region 209.

Figure 3:
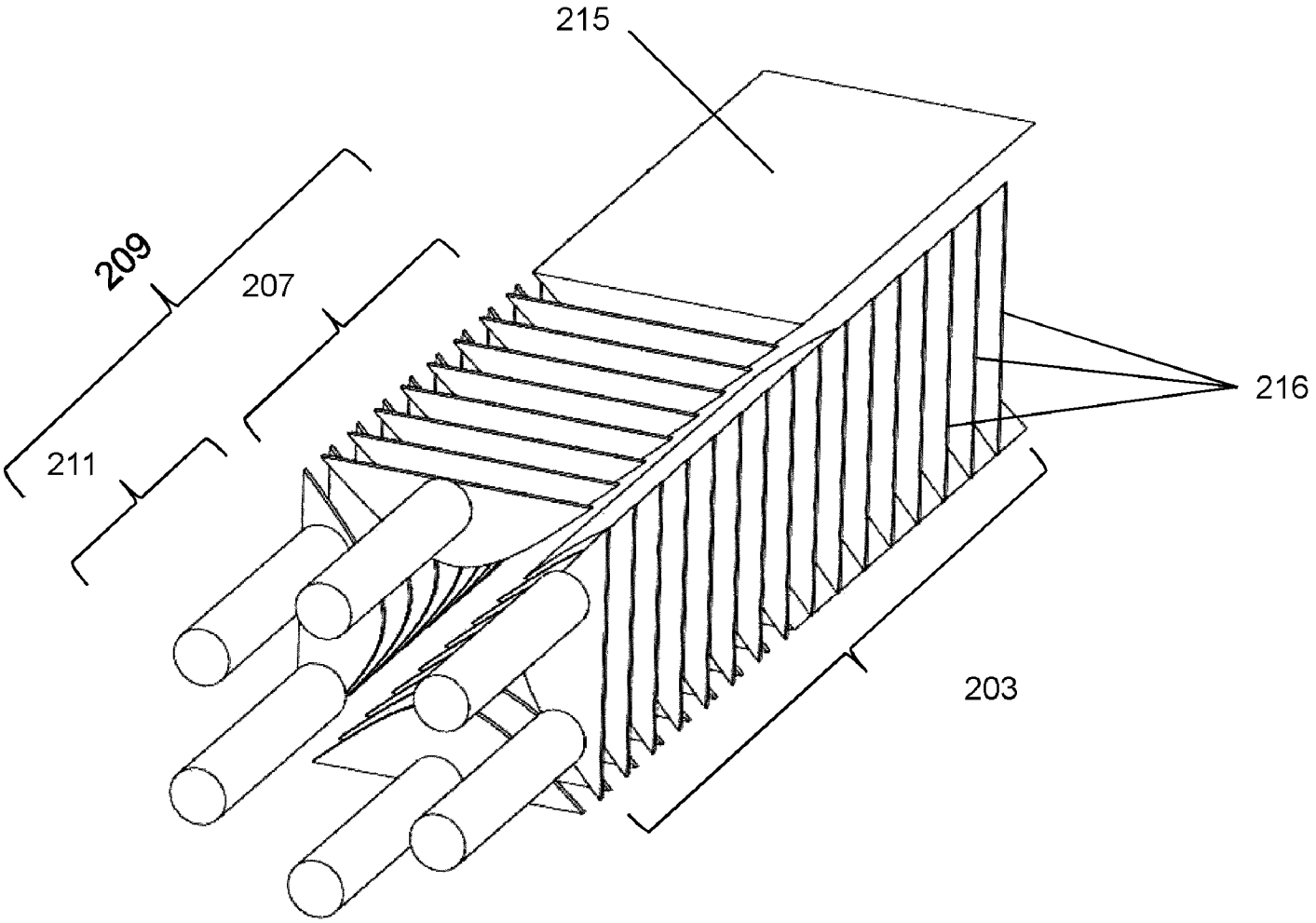
FIG. 3 is a 3D view of the ion injection region 209 shown in FIG. 2.

Precursor ions ejected from ion trap 201 may have a wide energy distribution, typically 0-40 eV. They may also have a wide angular distribution, in the range of 40°. A segmented multipole ion guide, e.g. hexapole or octupole, in focussing region 211 may be connected to RF supply voltages and assists to confine ions with wide angular spread. In the example shown in FIG. 2, this multipole ion guide is a hexapole, though an octupole could equally be used (and indeed may provide better compatibility with the downstream quadrupole). Focusing region 211 may also provide some ion cooling via collisions with buffer gas molecules. Injection region 209 may have a gas supply for setting a gas pressure in the injection region. With reference to FIG. 3, group gathering region 207 may in some embodiments be physically part of the ion transport device 203. Ion transport device 203 may be composed of unsegmented, continuous poles 215 and segmented poles 216 (see FIG. 216). In the gathering region 207 both sets of poles should preferably be segmented.

Electrodes of the group gathering region 207 may have an additional PSU for creating a DC gathering potential, i.e. the DC profile 219, an addition to the RF confining potential. In the present example the bunch forming region contains eight segmented electrodes all of hyperbolic profile and of inscribed radius 2.5 mm. In this example, the segmented electrodes have a thickness of 0.2 mm and the spacing of the electrodes is 2 mm. This is of course only one example embodiment of group gathering region 207, and other implementations are possible.

In operation, the ion trap 201 (ref FIG. 2) may be scanned, so that ions of progressively increasing ion m/z are ejected. For example, the ion trap may be scanned from 500Th to 1000Th. That is precursor ions at 500Th would be ejected first and then progressively increasing the m/z values of ions being ejected (with a window width of 1 Th) up to 1000Th. Thus the scan range here is 500Th. The resolving power of ion trap 201 should preferably be much greater than 1000. If the scan is completed in 250 ms, the scan rate would be 2000Th per second. Thus preferably, the ion transport device 203, which in this case is assumed to be an A-device, should be configured with a modulation frequency, f of 2000 Hz. The group gathering region 207 may have a cycle time accordingly of 0.5 ms to provide the scan rate of 2000Th per second. Within this cycle time, the gathering potential DC profile 219 may be applied for part of the cycle time and the transport potential is applied during a second part of the cycle time. The transport potential providing moving pseudopotential wells to transport ions from the bunch forming region 207 in to the ion transport device 203 is well known from WO2018/114442. This aspect may be implemented according to the principles described in WO2018/114442.

The scanning of the mass analyser 201 should be synchronised with the gathering potential and phase of the waveform of transport potential.

The gas pressure (Argon or He) at the multipole and gathering area may be $10^{-2}$ mbar.

The gathering potential may comprise an RF confining potential of ±300V and 2 MHz and several DC voltages to provide the gathering potential. The DC voltages are used to provide a DC profile 219 along the axis of the instrument at all the 8 segments: for example voltages of −2V, −2V, −2V, −14V, −14V, −14V, +16V, +16V were used in the simulation of the device (FIG. 2). In the transport phase of the cycle, the transport potential is applied in the group gathering region 207, a potential minimum, preferable a pseudo-potential minimum is created at the precise location of the ion group that is gathered by the above-described gathering potential. No DC profile is maintained at this stage. The group of ions can then be carried away and out of the group gathering region 207 into the remainder of the ion transport device 203. Then the gathering potential is reapplied for the first part of the next group gathering cycle, ready to receive the next group of precursor ions (which may be 1Th greater than the ions of previous bunch) from the LIT 201.

Referring back now to FIG. 1, once the mass selected precursor ions have been ejected from the ion trap 101 and placed into the moving pseudopotential wells, they are transported into the fragmentation region 113. The ion fragmentation region 113 is located within ion transport device 103. The invention allows for multiple methods of ion dissociation known in the art. Bunches of precursor ions are transported into the entrance of the ion fragmentation region 113, and a group of ions including product ions derived from the precursor ions are transported from an exit end of fragmentation region 113. The group of ions may contain the product ions derived from the precursor ions and possibly some remaining precursor ions. Correspondence data may be used to associate a particular pseudo-potential well in order to identify the nominal m/z of the precursor ions that were injected into it, e.g. for use in determining the m/z value of precursor ions for generating the MS/MS mass spectrum data.

The invention also allows for the combination of two or more fragmentation methods, which may be carried out in separate regions along the axis of the ion transport device.

Before describing embodiments for ion fragmentation region 113 of the current invention, an overview of the available methods in the art is provided:

CID: Molecular vibrations are excited by collisions of the precursor ion with buffer gas atoms/molecules and the molecular chain is dissociated at sites susceptible to cleavage. This requires that the precursor ions gain significant amounts of kinetic energy, so the depth of the trapping well is an important aspect of CID. CID provides a rapid dissociation method and generally non-resonant CID does limit throughput of analysis.

IRMPD: provides similar fragmentation as CID, it employs an infra-red laser from which the precursor ions absorb multiple photons in order to fragment. The absorbed IR photons also excite molecular vibrations, like CID. The main difference is that the parent ions do not gain significant amounts of kinetic energy. The sites susceptible to cleavage by CID or IRMPD are a-x and b-y in the peptide backbone (consisting of an amino acid sequence). Complete structural analysis cannot be achieved as some amino acid sequence patterns are not susceptible to cleavage, and information of modification sites (PTMs) cannot be gained as side chains (from the peptide backbone) are not preserved. CID & IRMPH are not available for top-down methods as large protein ions cannot be fragmented by CID & IRMPD.

UVPD: Ultraviolet photon dissociation is another adiabatic dissociating method. Commercially 1.2 μJ pulses of UV light are used at a pulse rate between 2 kHz and 3 kHz. UVPD does not selectively cleave bonds, and thus provides good sequence information and is available for PTM identification as well as top-down methods. UVPD is not sensitive to charge states and is available for positive and negative ions. This method is faster than ECD and ETD, but can still take between several milliseconds and several 10's of milliseconds.

HAD, NAD, OAD: Further methods are HAD, NAD, OAD are also known in the art. These methods stand for Hydrogen, Nitrogen and Oxygen detachment/attachment dissociation. Radicals are generated by thermal dissociation of the molecules by passing them through a heated element, for example a tungsten capillary (2000° C.), and injecting them into an ion trap containing the target precursor ions. The fragmentation spectra are shown to provide c/z and a/x type product ions, attributable to the attachment/abstraction of an electron to/from a precursor ion. The charge state of the precursor ions is maintained as the low-energy neutral radical initiates fragmentation. These methods are available for any charge state of precursor ion, including singly charged positive and negative ions.

ECD, ETD: These are adiabatic dissociating methods which utilise electrons; the bonds that are cleaved are less dependent on an amino acid sequence and c-z ions are produced. ECD/ETD are suitable for PTMs identification (as side chains are hardly cleaved in ECD and ETD and are applicable for top-down methods. However, they are only available for positive multiply charged ions. EID (electron induced dissociation) is another method similar to ECD, but utilises higher electron energies (~10 eV). ECD/EID predominantly employed due to the high cost of FT-ICR, although recently may be employed on other platforms with an applied magnetic field used to confine electrons within an ion trap. ETD is also commercially available in q-TOF, LIT-Orbitrap, LIT, QIT & FT-ICR instruments.

There is a drawback to some of these methods (such as UVPD, HAD, NAD, OAD, ECD or ETD) because the reaction is slow and takes several 10s of milliseconds or 100s of milliseconds to complete.

It is known in the art that CID and IRMPD together with ECD and ETD are mutually complementarily as they provide different information about the sequence. EThcD is used by some manufacturers to describe ETD followed by CID. In the prior art, the ETD reaction occurs in one ion trap and then the CID reaction in another. If the methods are to be used in combination then throughput of analysis further reduces.

In some embodiments the dissociation method implemented in ion fragmentation region 113 may be ETD. This method generally requires a negative ion source for generating negative reagent ions, suitable negative ions species for ETD are known in the art. During the electron transfer dissociation, precursor & product ions are conveyed in a single group as described in the previous paragraphs. As outlined in US2009278043 the ETD region may contain buffer gas, He or Ar.

In some embodiments the fragmentation method implemented in ion fragmentation region 113 may be ECD. This method requires electron sources, suitable electron sources are known in the art. It is also known in the art that digital trapping methods are particularly suited to ECD, as the waveform affords the opportunity to introduce electrons whilst the electric fields are constant in time, providing more efficient introduction of electrons and the possibility to control electron energy. The energy of electrons distinguishes between the methods of ECD and EID as described above. The digital method of ion trapping (employed here as to provide moving pseudo-potential wells in A-device) provides an increased electron density, and a more efficient reaction. As described in the prior art a magnetic field may be applied to the ion trapping region in order to further confine the electrons. Two or more electron sources may be used to ensure that the electron density is sufficient throughout ion fragmentation.

In some embodiments the dissociation method implemented in ion fragmentation region 113 may be HAD, NAD, or OAD. This may be achieved by passing Hz, Nz or $O_2$ gas through filament tubes, typically at 2000° C. to produce thermally dissociated radicals of H, N or O. The radicals are introduced as a neutral gas into the ion fragmentation region through one or more capillaries or tubes.

In some embodiments the dissociation method implemented in ion fragmentation region 113 may be UVPD. This may be achieved by introducing UV laser light into the ion fragmentation region. The laser may be introduced axially or radially and may use one or more UV mirrors to ensure that UV photons are present along the length of fragmentation region.

Figure 4:
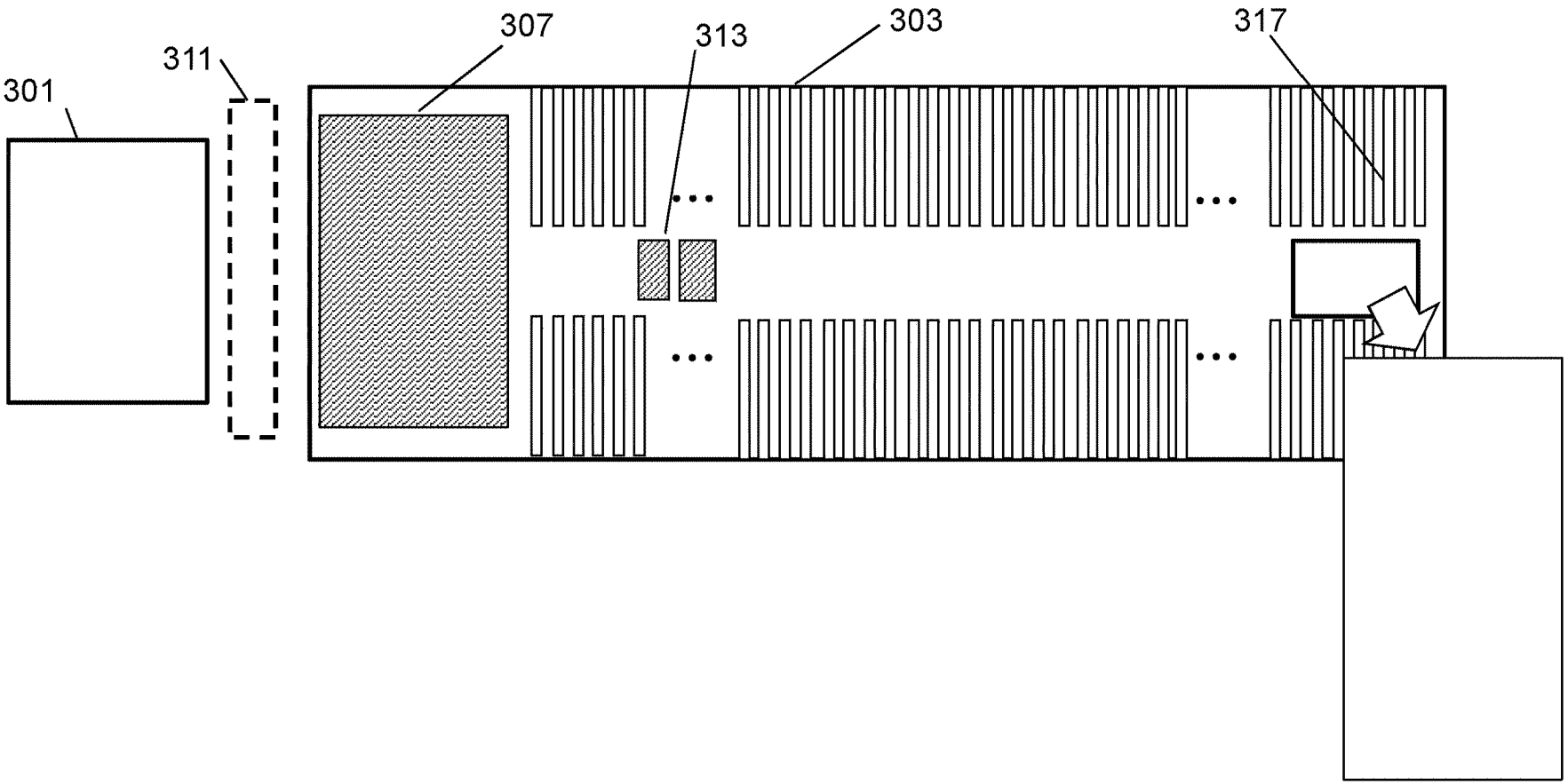
FIG. 4 is a schematic representation of an example implementation of the apparatus shown in FIG. 1 that is configured to implement CID in the ion transport device.
Figure 5:
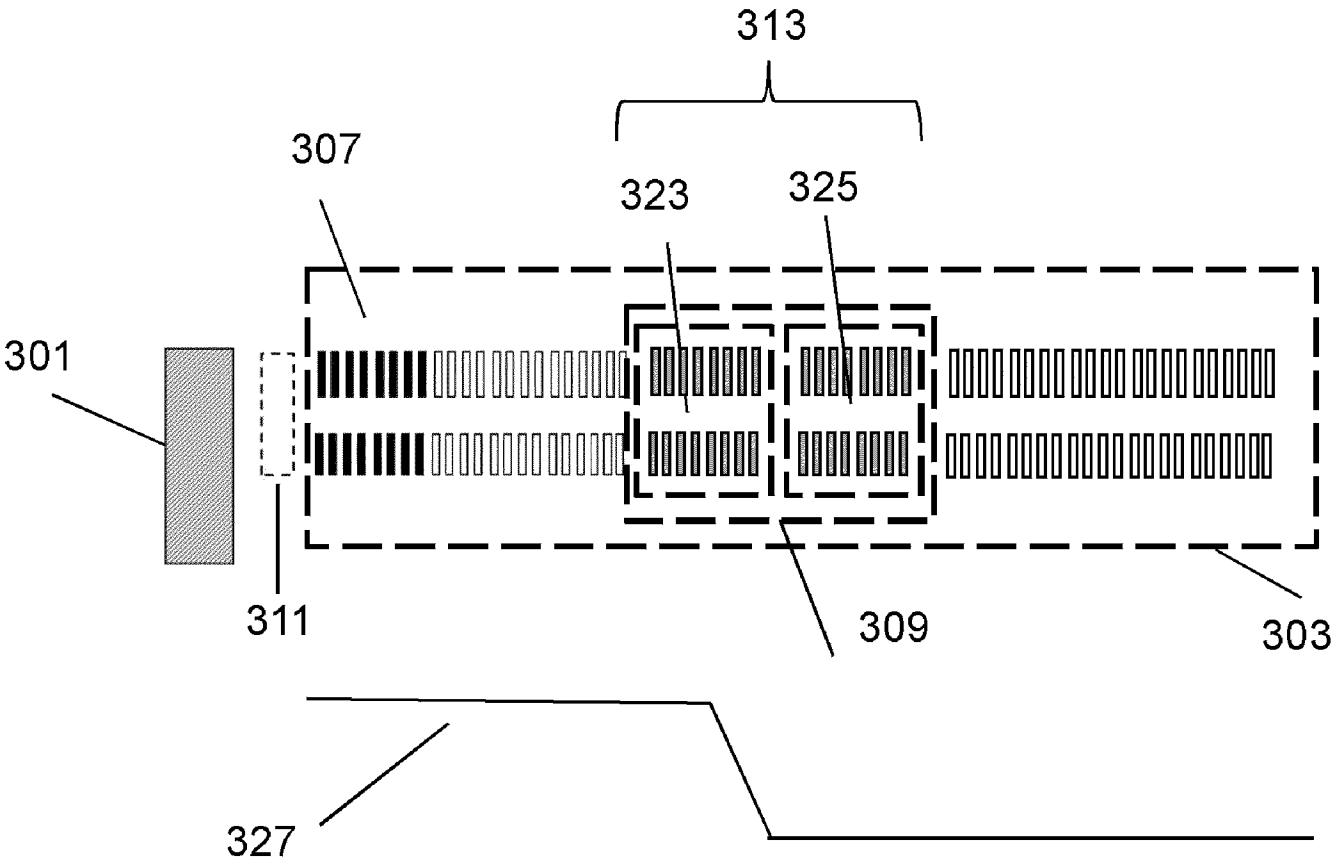
FIG. 5 shows in more detail the fragmentation area 313 of the apparatus shown in FIG. 4

In some embodiments the fragmentation method implemented in ion fragmentation region 113 may be CID, as shown in FIGS. 4 and 5.

CID may be achieved by accelerating ions along the axis of the fragmentation region 113, by the introduction of DC axial potential 327, as shown in FIG. 5. During operation the moving potential wells of the ion transport device 303 transport grouped precursor ions into a fragmentation region referred to here as CID region 323, the precursor ions are accelerated producing collision induced dissociated product ions. The kinetic energy gained by the precursor and product ions during this process may result in some ions spilling into neighbouring potential wells, which would deteriorate the performance of the mass spectrometer. To ameliorate this, a bunch reforming region 325 may be added to fragmentation region 313. Bunch reforming region 325 operates in an equivalent manner to the bunch forming region 307, principle and operation have been described above and is described in WO2018/114442. Using this approach CID may be carried out in ion fragmentation region 313 and a bunch of product ions derived from the precursor ions and any remaining precursor ions maybe transported from the exit end of fragmentation region 313 contained within a single moving potential well in a single bunch.

A skilled person would appreciate that various changes could be made to the apparatuses described above. Some examples of how this might be achieved will now be described.

For example, in relation to the first mass analyser 101 used to provide ions:

- This first mass analyser 101 may advantageously be composed of 2 or more ion traps. Ions may be made to move mass selectively (with relatively low mass resolving power, 5, 10) between the one or more ion traps so as to deliver ions to the final LIT (which ejects ions into the ion transport device) in advance of their subsequent ejection into the ion transport device.
- If the first mass analyser 101 includes a linear ion trap ("LIT"), the LIT could be extended in the axial direction (that is direction orthogonal to the axis of the transport device), so that the ions are ejected from the LIT in a wider, ribbon-like cloud in accordance with the with the length of the LIT, that is >10 mm, 20 mm, 30 mm or longer. Such an extended ion cloud could be gathered into a localised bunch within bunch forming region 107, and accepted by ion optical system (focusing system) 111, which could converge the extended beam towards the bunch forming region 107.
- If the first mass analyser 101 includes a LIT, the LIT could be have a curved axis so as the ejected ions are converged towards the ion optical system 111, or bunch forming region 107.
- Several LITs could be used to inject ions into a single ion optical region 111.
- Several LITs could be used to inject ions into several ion optical regions 111, which could be converged downstream into the bunch forming region 107.

Such modifications may help to improve the charge capacity of the first mass analyser 101. A LIT may have a capacity (before space charge effects start to deteriorate aspects of performance) of ~10000 ions/mm, so a LIT that can accommodate an ion cloud with a 30 mm axial length would contain at least 300,000 charges before the resolving power of the device is affected. Using 2 or more ion traps may achieve the largest jump in the ion capacity of the first mass analyser 101.

Figure 6:
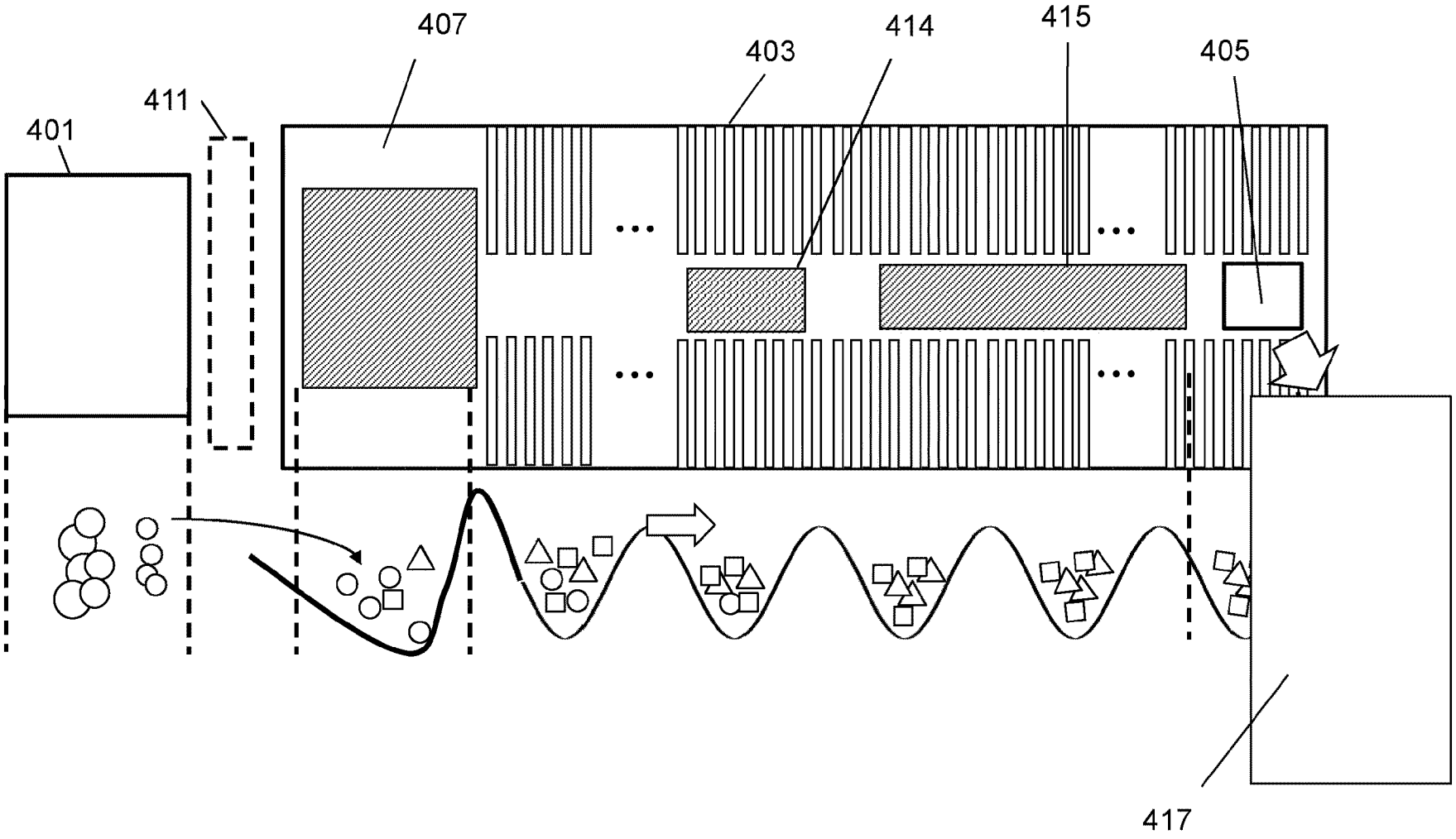
FIG. 6 is a schematic representation of an example implementation of the apparatus shown in FIG. 1 that is configured to implement CID before the ion transport device.

FIG. 6 shows an example variation of the CID example shown in FIG. 4, wherein the first mass analyser 401 is configured to initiate ion fragmentation during the ejection process. In this example, mass selected precursor ions, along with produced product ions, would enter the group forming region 407. Here a separate fragmentation region (e.g. fragmentation region 113 in FIG. 1) can be omitted as fragmentation may start in the group forming region 407 or within mass analyser 401. Fragmentation of the precursor ions during ejection may be made to happen e.g. by increasing the strength of a dipole voltage used to resonantly eject ions from mass analyser 401, controlling a DC offset voltage between mass analyser 401 and ion optical region 411, by adjusting the q parameter of the ion trap or by adjusting the buffer gas pressure in 401 and 411. This example is depicted in simplified form in FIG. 6, and is limited to CID fragmentation.

In some examples, broadband excitation means could be applied to remove high m/z product ions above a predetermined value, before and after dissociation steps, e.g. in the ion transport device. This is to remove ions outside the efficient conveying range of the ion transport device. This is in order to remove ions which are inefficient to convey in the ion transport device.

In some examples, the apparatus 100 may also be used as a device for the generation MS2×MS3 spectra, in which the MS1 isolation steps would be carried out by conventional methods in an upstream QMF (quadrupole mass filter). In this case the first MS1 stage might not be lossless.

In some examples, the ion transport device 103 could have a curved axis.

In some examples, the ion transport device 103 could have more than one extraction region 105.

In some examples, the ion transport device 103 could consist of one or more transport channels. One or more transport channels could be fed by one or more mass analyser one and deliver ions to one or more mass analyser 2.

In the foregoing description, the following features are believed to be desirable:

- An ion source, typically an ESI ion source, and means to convey ions to the ion trap.
- At least one ion trap and means to mass selectively eject precursor ion species.
- An ion transport device capable of transporting ions in confined bunches over an extended distance.
- A means to place the mass selectively ejected precursor ions into a confined bunch of ions within the ion transport device.
- At least one means to fragment the precursor ions, effective during at least part of the ions transport time along part of the ion transport device.
- A second mass analyser capable of analysing ions in confined bunches in the ion transport device.
- PSUs for providing voltages to the transport device, mass analyser 1 and 2 and to the injection devices.

As fragmentation is essential in MS/MS techniques, it is desirable that the travelling wells of the transport device can confine ions of a wide m/z range (M2/M1>10), for example as can be done by an A-device. In the illustrating simulations we used a waveform with an amplitude of 320 V (o-p), a frequency of 1.6 Hz and 8 phases, each with a 45° phase difference. The inventors found in practice that this could be achieved by the digital method (square wave) as disclosed in WO2012/150351 to provide the transport potential. An analogue design based on a RF generator to provide the voltage waveform (e.g. as taught by US2009/278043) was attempted but proved unsuccessful; fundamentally it seems this analogue method is difficult to achieve.

Preferred operating parameters are as follows:

- Gas pressure in the ion bunching region 107 was optimised at $1\times10^{-2}$ mbar of Ar or He. Although an acceptable range is $1\times10^{-4}$ mbar to 1 mbar, as stated in WO2018/114442. Also, if CID in the injection region is desirable, the pressure and the type of gas would be dictated by this factor. Normally it would stay in the acceptable region.

To date an A-device, which creates travelling pseudopotential wells, has been used by the present inventors. Specifically we use a segmented quadrupole electrode structure with an inscribed radii of 2.5 mm, some parts of the device may have at least one pole formed from a continuous rod, this is important if ions are to be extracted in a direction orthogonal to the axis in ion extraction region 105 (preferred embodiment—see FIG. 2 for a 3D example). A ring guide could alternatively be used if ions are to be transferred into the ToF analyser in a direction parallel to the axis of the ion transport device 103. The invention can comprise many ion guide structures as described in WO2012/150351. It is not essential to have a common electrode structure throughout the device (the configuration suggested is not necessarily the optimum one).

The length of the A-device is context specific.

The first mass analyser 101 is preferably a linear ion trap.

The second mass analyser 117 is preferably a ToF analyser.

Our preference is to use an ion transport device 103 in which a travelling pseudopotential well is generated, as in the A-device. However, the invention is applicable to an ion transport device in which the bunching is provided by travelling DC potential wells, though it should be noted that fragmentation methods that uses negatively and positively charged particles simultaneously could not be used with DC waves.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Any section headings used herein are for organisational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example+/−10%.

Simulation Data

EXAMPLE 1

With reference to FIG. 2, the combination of a first mass analyser, a transport device with travelling waves, and a second mass analyser, configured to perform near lossless two-dimensional mass spectrometry is unique and allows to avoid limitations of MS/MS methods described in the prior art. We note that some of the MS/MS methods described in the prior art referred to in the background section do not appear to have been reduced to practice.

In FIG. 2, ion injection into the injection region 209 using a bunching (gathering) potential as previously outlined in WO2018114442. New simulations of the ejection of ions from a mass analyser (LIT) 201 into the injection region 209 of the ion transport device 203, which was an A-device, have been carried out. Simulations were conducted with and without the ion optical system 211.

A brief description is given:

In the simulations we considered that CID may occur during the ejection of the ions from the ion trap and into the gathering region 207. Although it is noted that conditions where such CID occurs may be avoided. It is desirable that all the precursor ions and their product ions will remain inside the same predefined ion bunch formed in the gathering area 207. In these example simulations a bunch of precursor ions of m/z=786.4Th (Glu-Fib ions) was chosen. These ions were allowed to undergo fragmentation, resulting in product ions of m/z=168.7Th, 683.8Th and 1285Th with equal probability. The mass range of the product ions was therefore, $(m/z)_{max}/(m/z)_{min}=7.6$. The initial conditions of the precursors were: a nearly uniform distribution of kinetic energies in the range 0 eV to 40 eV, a nearly uniform distribution of the angles of momenta to the axis in the range −20° to +20°. In the simulation experiment precursor ions were ejected, mass selectively, from the LIT 201. They were subsequently gathered inside the gathering region 207 and were ready for collection by the travelling wave within a time of 180 μs. The mass uniformity, expressed as a ratio of product ions to precursor ions, gathered under the same conditions, was 0.94 or higher. The efficiency of the collection of precursor ions was 40% in the absence of focusing region 211.

Further simulations were conducted with a segmented multipole employed in focusing region 211 as shown in FIG. 2. This was found to reduce the losses of precursor ions, with transmission doubling to approximately 80%. Additionally, the product ion collection efficiency remained at 94% of the gathered precursor ions. Thus a segmented multipole employed in focusing region 211 was found to effectively introduce ions of high energy and angular spread.

The simulations showing the propagation of ions in the ion transport device are presented in prior art document US2014061457. Extraction of ions from the extraction region 5 was also presented in WO2018114442. The simulations of WO2018114442 & WO2012/150351 are included by reference.

We recap the advantages of the invention compared to the cited prior art. The product and precursor ions are presented to the second mass analyser as a defined bunch, i.e. without any spatial or energy dispersion. In the prior art system ions arrive at the 2nd mass analyser, not in a defined bunch but dispersed in time and space and with some mass segregation. Thus the MS2 data is gained over a number of cycles in the pusher region, within a number of single ToF spectra and low duty cycle. To resolve these issues the 2nd mass analyser must operate at the highest frequency possible, as described within the cited prior art. Thus in the cited prior art the second mass analyser must be a ToF analyser with a limited flight time. Maximum resolving power is related to the flight time.

In an alternative mode of operation of the prior art systems, the precursor ions and product ions could be collected (trapped) at the exit of the collision cell, and then pulsed to the second mass analyser.

Two limitations come from this mode:

1) Mass range is limited: the range of velocities of ions of wide m/z range: simply, if there is a m/z range, not all the ions will reside in the pusher region at the same time, i.e. some ions may have already passed through the pusher region (low m/z), and some may be yet to reach it (heavy m/z).
2) Time is needed to collect and cool the ions, thus the frequency of the spectrum is reduced.

Furthermore, in the cited prior art MS/MS scheme, ions travel through in a short time, <1 ms. As a result:

1) There is no time for fragmentation by methods other than CID or IRMPD.
2) Ions arrive at the second mass spectrometer with relatively high energies (higher than the thermal energy kT) with no time available for cooling. Thus to achieve a reasonable resolving power in the ToF analysers, phase space is inevitably cut (cutting off some undesirable ions with poor velocities), which leads to reduced sensitivity in the prior art system.

REFERENCES

A number of publications are cited above in order to more fully describe and disclose the invention and the state of the art to which the invention pertains. Full citations for these references are provided below. The entirety of each of these references is incorporated herein.

1. WO2012/150351 (also published as U.S. Pat. Nos. 9,536,721, 9,812,308)
2. US2009/278043
3. GB2391697
4. WO2018/114442
5. U.S. Pat. No. 6,770,871
6. U.S. Pat. No. 7,507,953
7. "A Qit-q-Tof mass spectrometer for two-dimensional tandem mass spectrometry", Wang et al, Rapid Communications in Mass Spectrometry, 2007, 21: 3223-3226 [https://onlinelibrary.wiley.com/doi/pdf/10.1002/rcm.3204]
8. Chapter 4 from "Practical Mass Spectrometry Volume 1", Raymond E. March and John F. J. Todd.
9. "A digital ion trap mass spectrometer coupled with atmospheric pressure ion sources" (Ding et al, J Mass Spectrom, May 2004, 39(5); 471-84)

The invention claimed is:

1. An apparatus for analysing ions, the apparatus including:

a first mass analyser configured to eject groups of ions from the first mass analyser in a predetermined sequence such that each group of ions is ejected during a different time window and is initially formed from precursor ions having m/z values in a respective m/z value window, wherein the first mass analyser is configured to, when ejecting each group of ions, retain at least some of any other ions contained in the first mass analyser prior to the group of ions being ejected;

an ion transport device having a plurality of electrodes arranged around a transport channel, wherein the ion transport device is configured to receive at least some groups of ions ejected from the first mass analyser;

control computer configured to control voltages applied to the electrodes of the ion transport device to generate a transport potential in the transport channel, the transport potential having a plurality of potential wells which are configured to move along the transport channel, the control computer being configured to generate the transport potential such that each group of ions received by the ion transport device is respectively transported along the transport channel by one or more selected potential wells in the transport potential;

fragmentation device configured to fragment precursor ions in each group of ions so as to produce product ions;

a second mass analyser configured to produce a respective mass spectrum using each group of ions after the group of ions has been fragmented by the fragmentation device and transported along the transport channel;

wherein the apparatus is configured to leave empty one or more potential wells on either one side or both sides of the one or more selected potential wells respectively transporting each group of ions in the ion transport device.

2. An apparatus according to claim 1, wherein the apparatus includes a two dimensional mass spectrum data deriver for deriving two-dimensional mass spectrum data based on the mass spectra produced using each group of ions, wherein two-dimensional mass spectrum data comprises data including a respective mass spectrum of product ions resulting from fragmentation of each of multiple groups of precursor ions, each group of precursor ions having m/z values in a different m/z value window.

3. An apparatus according to claim 1, wherein the apparatus includes a group gathering unit configured to receive each group of ions that is to be received by the ion transport device in a different respective time period, wherein a plurality of group gathering electrodes are positioned around a group gathering region of the group gathering means, wherein the control computer is configured to control the voltages applied to the group gathering electrodes to, for each group of ions received by the group gathering means:

temporarily generate a gathering potential in the group gathering region so that the group of ions received by the group gathering region is gathered in the group gathering region; and generate a potential in the group gathering region to introduce the ions to one or more selected potential wells of the transport potential in the transport channel.

4. An apparatus according to claim 3, wherein the group gathering unit is part of the ion transport device, with the group gathering electrodes being electrodes of the ion transport device, and with the group gathering region being a region within the ion transport device.

5. An apparatus according to claim 1, wherein the fragmentation device includes part of the ion transport device configured to fragment ions as they are transported through a fragmentation region of the ion transport device.

6. An apparatus according to claim 5, wherein the part of the ion transport device configured to fragment ions as they are transported through a fragmentation region of the ion transport device is configured to fragment ions by one or more of UVPD, HAD (Hydrogen Attachment Dissociation), NAD (Nitrogen Attachment Dissociation), OAD (Oxygen Attachment Dissociation), ECD or ETD.

7. An apparatus according to claim 5, wherein the apparatus is configured to retain each group of ions in the fragmentation region for 10 ms or more.

8. An apparatus according to claim 5, wherein the fragmentation region is 20 mm or longer.

9. An apparatus according to claim 7, wherein the fragmentation region is 20 mm or longer.

10. An apparatus according to claim 1, wherein the fragmentation device includes ion optical elements in a region located between the first mass analyser and the ion transport device, wherein the ion optical elements are configured to accelerate ions to cause fragmentation of ions by CID.

11. An apparatus according to claim 1, wherein the fragmentation device includes the first mass analyser, and the first mass analyser is an ion trap configured to fragment the precursor ions whilst those precursor ions are being ejected from the ion trap by ejecting the ions with adequately high kinetic energies so as to cause CID.

12. An apparatus according to claim 1, wherein the first mass analyser is an ion trap.

13. An apparatus according to claim 1, wherein each m/z value window is less than 2Th wide.

14. An apparatus according to claim 1, wherein:

the ion transport device includes a plurality of extraction electrodes, wherein the control means is configured to control the extraction electrodes to generate an extraction potential configured to extract each group of ions from the transport channel when the one or more selected potential wells carrying that group of ions reaches one or more extraction regions of the transport channel.

15. An apparatus according to claim 14, wherein the second mass analyser is preferably a time of flight, "ToF", mass analyser, and the extraction potential is configured to extract each group of ions into the ToF mass analyser.

16. An apparatus according to claim 1, wherein the apparatus includes a preliminary analyser, upstream of the first mass analyser, wherein the preliminary analyser is configured to eject precursor groups of ions from the first mass analyser in a predetermined sequence.

17. An apparatus according to claim 1, wherein the apparatus includes multiple ion transport devices, wherein each ion transport device has a plurality of electrodes arranged around a transport channel, wherein the transport channel of each ion transport device is configured to receive a respective subset of groups of ions ejected from the first mass analyser.

18. An apparatus for analysing ions, the apparatus including:

a first mass analyser configured to eject groups of ions from the first mass analyser in a predetermined sequence such that each group of ions is ejected during a different time window and is initially formed from precursor ions having m/z values in a respective m/z value window, wherein the first mass analyser is configured to, when ejecting each group of ions, retain at least some of any other ions contained in the first mass analyser prior to the group of ions being ejected;

an ion transport device having a plurality of electrodes arranged around a transport channel, wherein the ion transport device is configured to receive at least some groups of ions ejected from the first mass analyser;

control computer configured to control voltages applied to the electrodes of the ion transport device to generate a transport potential in the transport channel, the transport potential having a plurality of potential wells which are configured to move along the transport channel, the control computer being configured to generate the transport potential such that each group of ions received by the ion transport device is respectively transported along the transport channel by one or more selected potential wells in the transport potential;

fragmentation device configured to fragment precursor ions in each group of ions so as to produce product ions;

a second mass analyser configured to produce a respective mass spectrum using each group of ions after the group of ions has been fragmented by the fragmentation device and transported along the transport channel;

wherein the ion transport device includes a group re-gathering region configured to receive each group of ions respectively transported along the transport channel by the transport potential in a different respective time period, wherein a plurality of group re-gathering electrodes are positioned around the group re-gathering region, wherein the control computer is configured to control the voltages applied to the group re-gathering electrodes to, for each group of ions received by the group re-gathering region:

temporarily generate a gathering potential in the group re-gathering region so that the group of ions received by the group gathering region is re-gathered in the group re-gathering region; and generate a potential in the group re-gathering region to introduce the ions back to the one or more selected potential wells of the transport potential in the transport channel.

* * * * *